US005501430A

United States Patent [19]

Yamaoka et al.

[11] Patent Number: 5,501,430

[45] Date of Patent: Mar. 26, 1996

[54] IMMERSION NOZZLE FOR CONTINUOUS CASTING

[75] Inventors: Yuichi Yamaoka; Katsuhiko Murakami, both of Kawasaki; Mikio Suzuki, Sendai, all of Japan

[73] Assignee: NKK Corporation, Tokyo, Japan

[21] Appl. No.: 320,862

[22] Filed: Oct. 11, 1994

[30] Foreign Application Priority Data

Oct. 13, 1993 [JP] Japan ..... 5-278879
Feb. 22, 1994 [JP] Japan ..... 6-046543

[51] Int. Cl.[6] ..... B22D 35/00

[52] U.S. Cl. ..... 266/236; 222/606

[58] Field of Search ..... 266/236; 222/606, 222/607; 164/335, 337

[56] References Cited

U.S. PATENT DOCUMENTS

| | | | |
|---|---|---|---|
| 3,888,294 | 6/1975 | Fastner et al. | 164/281 |
| 4,042,007 | 8/1977 | Zavaras et al. | 164/281 |
| 4,510,191 | 4/1985 | Kagami et al. | 222/606 |
| 4,949,778 | 8/1990 | Saito et al. | 222/606 |

FOREIGN PATENT DOCUMENTS

| | | | |
|---|---|---|---|
| 0150549 | 8/1985 | European Pat. Off. . | |
| 0321206 | 6/1989 | European Pat. Off. . | |
| 843137 | 7/1952 | Germany . | |
| 285841 | 11/1970 | Germany . | |
| 2509284 | 9/1975 | Germany . | |
| 61-14051 | 1/1986 | Japan . | |
| 62-296944 | 12/1987 | Japan . | |
| 5131250 | 5/1993 | Japan | 222/606 |
| 1474878 | 5/1977 | United Kingdom . | |

OTHER PUBLICATIONS

Patent Abstract Of Japan, unexamined applications, Section M, vol. 12, No. 183, May 28, 1988, p. 163 M 703; JP–A–62 296 944 (Kawasaki Steel Corp.) The Patent Office Japanese Government.

*Primary Examiner*—Scott Kastler
*Attorney, Agent, or Firm*—Frishauf, Holtz, Goodman, Langer & Chick

[57] ABSTRACT

An immersion nozzle for continuous casting have an immersion nozzle body, at least one opening hole for receiving the molten metal, a vertical bore, at least one pair of exit ports for introducing the molten metal into the mold through the vertical bore, a slit opening for introducing the molten metal downwardly and a downwardly convex surface of the bottom of the vertical bore.

The slit opening is located at a bottom end of the body of said immersion nozzle which is below the exit ports and in parallel to the width direction of the mold.

15 Claims, 17 Drawing Sheets

1:POSITIONED AT 100mm ABOVE TOP END OF EXIT PORT

1:POSITIONED AT 10mm ABOVE TOP END OF EXIT PORT

3:POSITIONED AT MIDDLE BETWEEN LOWER END AND TOP END OF SLIT OPENING

IMMERSION NOZZLE FOR CONTINUOUS CASTING

BACKGROUND OF THE INVENTION

1. Field of the Invention

The present invention relates to an immersion nozzle for introducing molten metal from a tundish to a mold for continuous casting of molten metal, and more particularly to a structure of the immersion nozzle.

2. Description of the Related Arts

An immersion nozzle made of refractory material is used to introduce molten steel from a tundish to a continuous casting mold. Particularly when a high speed casting for producing a slab is carried out, a shape of an immersion nozzle which has a pair of exit ports opening toward a shorter side of the mold as shown in FIG. 20 (A) and FIG. 20 (B) presently is used in general.

And in a continuous casting, it is generally required to solidly the molten steel stably and to remove, by floatation, non-metallic inclusion contained in the molten steel which causes ingot defects.

Therefore, an immersion nozzle is required to have flow of molten steel dispersed uniformly in the mold, to have non-metallic inclusion floated, and to give an adequately uniform flow of the molten steel on the surface of the molten steel in the mold. In addition, it is wanted that the molten steel which is discharged from left and right exit ports on a side wall of the nozzle and then moves toward the shorter side on left and right of the mold makes no flow difference on both directions and that the molten steel flow which hits the shorter side of the mold and is separated into an upward flow and a downward flow gives an adequate flow rate in a shorter side upward flow.

If a surface flow speed of the molten steel within the mold is not in an adequate range, problems described below occur. When the surface flow speed of the molten steel is lower than the adequate range, the heat of the molten steel introduced through the exit ports is insufficient, which may cause a partial solidification of the molten steel surface to bring the solidified pieces into an ingot to result in an ingot defect and, in the worst case, in an interruption of casting operation. When the surface flow speed of the molten steel is above the adequate range or when an unbalance flow of the molten steel is excessive, powder floating on the molten steel surface is entrapped into the ingot to raise powder defects, which causes degradation of the ingot in quality.

When the unbalance flow of the molten steel occurs, a penetration depth of the molten steel flow downward into a molten steel pool in the mold increases by 20 to 40% more than that of normal operation, which makes floatation of alumina inclusion difficult.

To solve the problems described above, an immersion nozzle as illustrated in FIG. 21 was disclosed by Unexamined Japanese Patent Publication No. 62-296944. The disclosed immersion nozzle has a pair of exit ports opened at a side wall body of the nozzle toward the shorter side wall of the mold with a downward slope and a slit opened at the bottom of the nozzle, crossing the nozzle bottom with an angled shape while connecting with both exit ports (this type of nozzle is hereinafter referred to as "a two-exit port nozzle with connected slit").

Another type of immersion nozzle was disclosed in Unexamined Japanese Patent Publication No. 61-14051, which is shown in FIG. 22. The nozzle is also a two-exit port nozzle with connected slit which connects left and right two-exit port on the side wall of the nozzle with the slit crossing the tip of the nozzle. In that case, however, the shape of the nozzle tip is hemispherical.

Since that type of immersion nozzle feeds a part of the molten steel downward into the mold through the slit opened at the tip of the nozzle, the quantity of the molten steel fed through the side exit ports toward the shorter sides of the mold decreases, and the surface flow speed of the molten steel in the mold reduces, which prevents inclusion of mold powder on the molten steel surface.

FIG. 23 illustrates a water model experimental result simulating a molten steel flow pattern inside of the mold using a two-exit port nozzle with connected slit of FIG. 21. The molten steel flows out through the exit ports of the side wall of the nozzle and moves toward the shorter side of the mold, hits the solidification shell of ingot, and is separated into an upward flow along the shorter side (hereinafter referred to as "short side upflow") and a downward flow (hereinafter referred to as "short side downflow"). The shorter side upflow reaches the molten steel surface in the mold to swell up at the surface of the molten steel, then it becomes a surface flow moving from the shorter side toward the center of the mold.

Since the nozzle feeds the molten steel also through the bottom slit, the speed of the short side upflow is small, and the fluctuation of the surface on the molten steel in the mold is also small. In addition, the molten steel which has flowed out through the bottom slit spreads in a width direction of the mold to result in a shallow penetration depth into the molten steel. The nozzle of FIG. 21, however, induces an unbalanced flow where a flow rate of the molten steel through one side outlet of the exit ports increases, while another flow rate coming through another side outlet of the exit ports decreases. Consequently, on the outlet side of the excessive discharge, the short side upflow is enhanced to increase the fluctuation of the surface of the molten steel.

Furthermore, the molten steel flowing out through the bottom slit does not spread in the width direction of the mold, and a flow band segregates to the side of enhanced short side upflow. Accordingly, the flow band competes with the short side downflow to generate a powerful downflow (hereinafter referred to as "mold downflow") which penetrates deep into the mold.

The unbalance of the molten steel flowing out through the exit ports differs, in the left or the right side of the mold as time passes. As a result, there occurs an abnormal surface level fluctuation of the molten steel in the mold, generating vortices in the vicinity of the nozzle to induce inclusion of mold powder. Further, no improvement in penetration depth of non-metallic inclusion in the molten steel is made due to the mold downflow, either. Thus, that type of nozzle gives very few improvements compared with a prior art nozzle of two-exit ports which does not have the bottom slit (FIG. 20(*a*) and FIG. 20(*b*)).

SUMMARY OF THE INVENTION

It is an object of the present invention to provide an immersion nozzle having a structure, which enables to reduce inclusion defects inside of an ingot by preventing an excessive fluctuation of the surface level within a mold and by reducing the penetration depth of molten metal down into the mold.

In order to attain the object, in accordance with the present invention, an immersion nozzle for continuous casting is provided, comprising:

(a) an immersion nozzle body leading molten metal from a tundish into a mold for continuous casting;

(b) said immersion nozzle body having at least one opening hole for receiving the molten metal from the tundish at a top end of said immersion nozzle body;

(c) said immersion nozzle body having a vertical bore which has a center axis;

(d) said immersion nozzle body having at least one pair of exit ports for introducing the molten metal into the mold through said vertical bore at a bottom portion of said body of said immersion nozzle, said exit ports being located in parallel to a width direction of the mold and symmetrically with regard to a cross sectional plane passing through a center axis of said vertical bore;

(e) said body of said immersion nozzle having a slit opening for introducing the molten metal downwardly through said exit ports, the slit opening being located at a bottom end of said immersion nozzle body which is below said exit ports and in parallel to the width direction of the mold; and (f) a bottom of said vertical bore being formed with a downwardly convex surface and located below said exit ports.

The present invention further provides an immersion nozzle for continuous casting comprising:

(a) an immersion nozzle body leading molten metal from a tundish into a mold for continuous casting;

(b) said immersion nozzle body having at least one opening hole for receiving the molten metal .from the tundish at a top end of said body of said immersion nozzle;

(c) said immersion nozzle body having a vertical bore which has a center axis, a horizontal cross sectional area of said bore being reduced in a direction downwardly from the top end of said immersion nozzle body;

(d) said immersion nozzle body having at least one pair of exit ports for introducing the molten metal into the mold through said vertical bore at a bottom portion of said immersion nozzle body, said exit ports being located in parallel to a width direction of the mold and symmetrically with regard to a cross sectional plane passing through a center axis of said vertical bore;

(e) said immersion nozzle body having a slit opening for introducing the molten metal downwardly through said exit ports, the slit opening being located at a bottom end of said immersion nozzle body which is below said exit ports and in parallel to the width direction of the mold; and (f) said vertical bore being formed with a downwardly convex surface and located below said exit ports and an horizontal cross sectional area of said vertical bore being reduced in a direction downwardly from the top end of said body of said immersion nozzle.

DESCRIPTION OF THE EMBODIMENT

The causes of the disadvantages found in the prior art two-exit port nozzle with connected slit, or of the phenomena of unbalance flow of the molten steel through the exit ports and occurrence of aggressive mold downflow were clarified through a series of casting experiments using a continuous casting machine and observation of water model experiments using a scale model. According to the findings in those experiments, the flow of the molten steel coming down through the vertical bore of the immersion nozzle has an unbalance, and the unbalance induces a difference in flow rates of the molten steel flowing out through left and right discharge openings on side wall of the nozzle. Furthermore, the molten steel flowing out through the bottom slit of the nozzle tip portion spreads nonuniformly in the width direction of the mold. As a result, a downflow band moving deep into the mold occurs owing to the above described phenomena, separately or competitively.

To cope with these phenomena, the present invention adopts a shape in which, different from the prior art two-exit port nozzle with connected slit, a pair of exit ports located on the side wall of a lower part of the cylinder beneath a top open hole do not connect to the opening of the bottom slit. In that case, even if an unbalanced dynamic pressure of one-sided molten steel is generated within a vertical bore in the nozzle, the exit ports only are affected by the phenomenon, and the bottom slit is free from the affect of the dynamic pressure because the slit opens beneath the discharge outlet opening. Furthermore, since the size of the exit port opening can be narrowed as much as a magnitude of the opened area of the bottom slit, the generation of the unbalance flow is suppressed. Thus, the present invention was completed as described below. The shape of the cylinder can be any one of circular, elliptical and polygon. And the cross sectional area is not necessarily constant in the vertical direction.

Figures 1A, 1B:
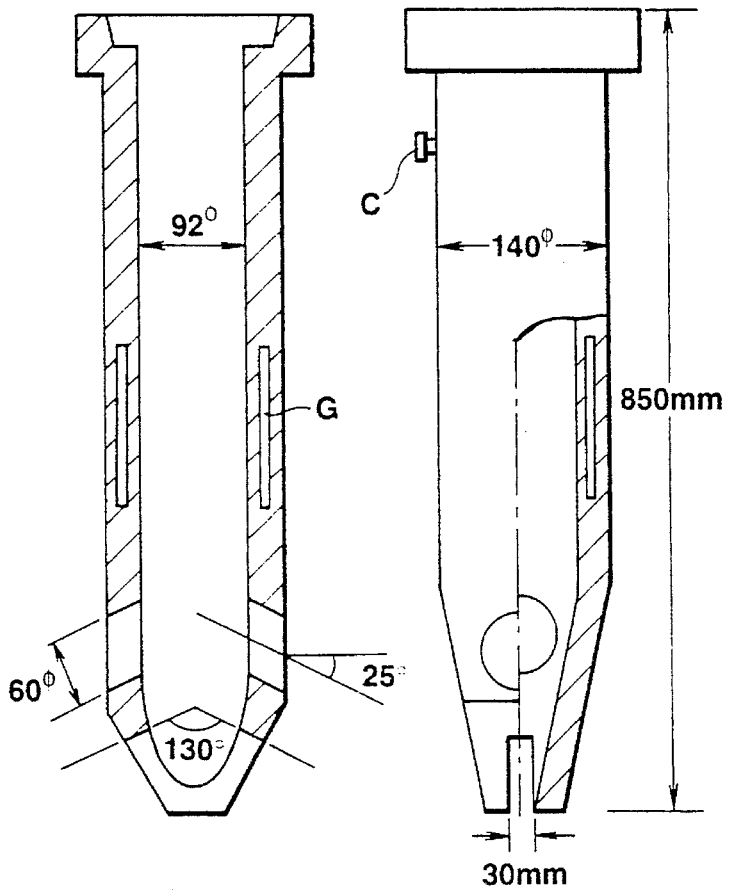
FIGS. 1(A) and 1B) show an example of immersion nozzle of the present invention.

An example of the immersion nozzle of the present invention is given in FIGS. 1(A) and 1(B) The immersion nozzle has an open hole at its top to connect with a sliding nozzle unit and has a cylindrical intermediate portion having a vertical bore. When at least one of a pair of exit ports for discharging the molten steel are opened to a direction in width of the mold at a lower portion of the nozzle, another small discharge exit port opening to the thickness direction of the mold, for example, can be opened.

The difference of the nozzle of the present invention from prior art ones is that a distance between a lower edge of a pair of the exit ports and an upper edge of a slit, (hereinafter the distance part is referred to as "partition wall"), is kept, for example, at 40 mm long in height direction, and that a bottom face of the vertical bore of the nozzle is downward convex, and that an opening gap of the bottom slit is 30 mm long. In addition, the nozzle of the invention has a gas permeation layer (G) for blowing in argon gas and a gas supply opening (C) in a side wall of the nozzle, and it is mounted to a nozzle of the sliding nozzle unit from a bottom side of the sliding nozzle.

In addition to the above-described improvement, the immersion nozzle of the present invention adopts an improvement that the molten steel flows out through the bottom slit in a fan shaped flat pattern in a downward and width direction of the mold and spreads widely. For instance, the bottom face of the vertical bore of the nozzle is formed in a downward convex shape. And in the bottom, a nearly rectangular slit having a narrow opening which is parallel to a width side of the mold is opened to the downward direction of the mold. The molten steel in the nozzle flows out through the slit in the direction of its internal (static) pressure applied, or at a right angle to the downward convex inner face, so the bottom slit makes the flow of the molten steel fan shaped flat pattern in the width direction of the mold.

The molten steel which flows out through the bottom slit forms a fan shaped flat pattern so long as the shape of the bottom of the vertical bore in the nozzle is downward convex. And the convex shape can be an arbitrary three dimensional one such as a hemisphere, ellipse and sphere, or can be an arbitrary two dimension one such as a cylindrical shape and polygon in a slit length direction, regardless of the entire shape or a part of it.

When no partition wall is provided between the slit and the side wall exit ports providing a connection of them to each other, an unbalance flow of the molten steel flowing down through the vertical bore of the immersion nozzle gives a difference of flow rate of the molten steel flowing out through the exit ports on each side wall of the nozzle, and further the molten steel flowing out through the bottom slit spreads nonuniformly in the width direction of the mold. As a result, the flow of the molten steel in the mold becomes unbalanced and induces mold powder inclusion owing to the generation of vortices. When the dimension of the partition wall is 20 mm or less, the flow from the side wall exit ports and the flow from the bottom slit interfere each other so that the effect of the partition wall hardly appears. Therefore, an effective dimension of the partition wall is 20 mm or more.

The number of the exit ports of the side wall is two in an example given in FIGS. 1(A) and 1(B) The number is, however, not limited to a pair, and two pairs can be used. The condition requested is to give a downward convex shape for the bottom surface of the vertical bore, and the effect of the present invention is obtained if the exit ports and the bottom slit are not connected to each other.

The molten steel flowing out through the bottom slit becomes a fan shaped flat pattern flow uniform to the width direction of the mold, so long as the shape is symmetrical with regard to a cross sectional plane across the nozzle center axis. The shape of the cross sectional bottom surface of the vertical bore of the nozzle in the width direction can be a arbitrary line or curve such as a circular arc, ellipse, or parabola. Selection of the shape of the bottom surface of the vertical bore of the nozzle allows an adjustment of the degree of spreading of the flowed out molten steel. Also selection of the length along the slit length or the angle of opening allows the adjustment of spreading width of the fan-shaped flat pattern flow.

It is preferable to select the flow rate of the molten steel coming out from the slit and to reduce the opening gap of the bottom slit to a degree of generating a molten steel pressure on the opening portion of the slit at the bottom of the vertical bore of the nozzle. When the internal (static) pressure is weak, an effect of dynamic pressure induced by the flow of the molten steel inside of the nozzle becomes predominant to enhance nonuniform discharge of the molten steel from a part of the bottom slit. In this respect, a water model test can be employed to determine an optimum gap demension for a specific casting condition to assure a uniformly spread fan shaped flat pattern flow.

EXAMPLE

Example 1

With an assumption of an ordinary slab continuous casting (200 to 250 mm in thickness and 1200 to 2000 mm in width), a water model testing apparatus was used. The water model testing apparatus was fabricated by transparent acrylic resin comprising a tundish, a mold, and two types of immersion nozzles, with a scale of ⅓. The flow of the molten steel was simulated by Fluid number, a non-dimensional number. The nozzles tested were an immersion nozzle of the present invention and a prior art two-exit port nozzle with connected slit.

With these prepared nozzles, the flow of molten steel inside of the mold and the surface flow of the molten steel in the mold were observed, and a series of tests were conducted to study (a) the spreading pattern of the molten steel flowing out through the bottom slit into the width direction of the mold, (b) the difference of flow rate of the molten steel flowing out through left and right exit ports, (c) the interference of the molten steel flowing out through the exit ports and that flowing out through the bottom slit to the outside of the nozzle, and (d) the fluctuation of the surface level of the molten steel in the mold induced by the short side impinged upflow of molten steel flowing out through the exit ports. The condition of these tests are listed in Table 1.

Figure 23:
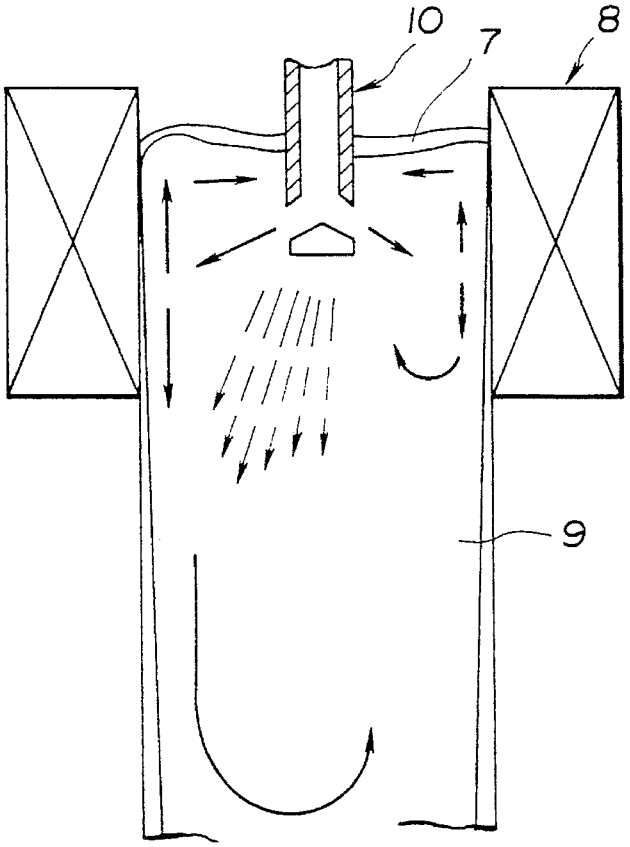
FIG. 23 illustrates a flow of molten steel in the mold using a prior art two-exit port nozzle with connected slit (R1, given in FIG. 21).

The observed results on the prior art two exit port nozzle with connected slit (R1) for the molten steel flow within the mold and the surface layer flow of the molten steel in the mold are illustrated in FIG. 23 and outlined before. Further detailed description is given below. As for the spreading state (a) of the molten steel flowing out through the bottom slit in the width direction of the mold, the angled bottom of the vertical bore prevented a broad distribution into the width direction of the mold, and likely induced an unbalanced downflow of a band stream moving downward the mold toward the left or right to the width direction of the mold.

Regarding the nozzle R1, either one of the left and right exit ports gave higher discharge rate of the molten steel to yield a difference in flow rate (b) between the two exit ports, and the flow of higher flow rate of the molten steel generated a short side upflow after impinging the ingot short side solidification shell. As a result, there was a rise of the molten

TABLE 1

| | | Bottom Slit | | Down Angle of | Observed Results | | | |
|---|---|---|---|---|---|---|---|---|
| Test nozzle Group | | Spread Eagle β (°) | Connection of Exit Ports | Exit Port α (°) | Slit Spread Angle of Molten Steel (a) | Difference of Flow between Exit Ports (b) | Interference at Outside of Nozzle (c) | Level Fluctuation of Molten Steel |
| Present Invention | A | 80–90 | None | 35–15 | X | ⊙ | ⊙ | ⊙ |
| | B | 100–120 | None | 35 | ⊙ | ⊙ | ⊙ | |
| | C | 130–180 | None | 35 | ⊙ | ⊙ | X | X |
| | D | 100–150 | None | 25 | ⊙ | ⊙ | ⊙ | ⊙ |
| | E | 160–180 | None | 25 | ⊙ | ⊙ | ⊙ | ⊙ |
| | F | 100–180 | None | 15 | ⊙ | ⊙ | X | X |
| Angle Bottom | R1 | 130 | Yes | 25 | X | X | X | Unstable |
| Hemispheric Bottom | R2 | 130 | Yes | 25 | ⊙ | X | X | Unstable |

Figures 2A, 2B:
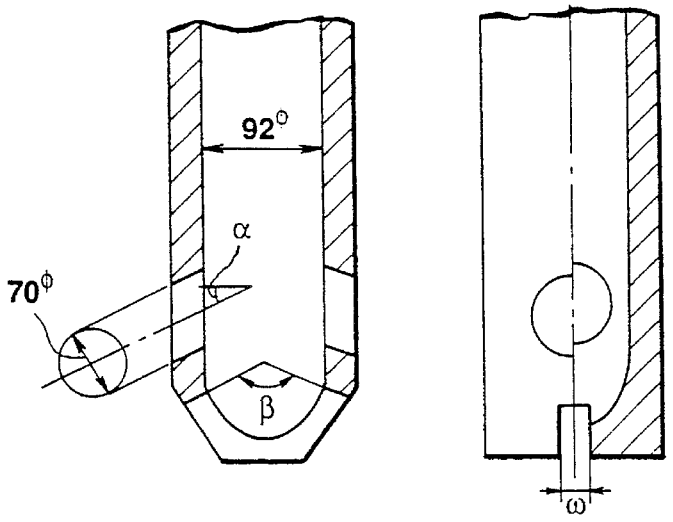
FIGS. 2(A) and 2(B) give dimensions and angles of each part of an immersion nozzle used in a test of the present invention.

Measurement on several points in the mold was also conducted using more than one miniature propeller flow speed detector, and the measured signals at symmetrical points on left and right sides of the mold at the same time were continuously recorded to quantify the unbalance flow phenomenon on each point. The immersion nozzle used in the water model test is shown in FIGS. 2(A) and 2(B), which is a type of the present invention shown in FIGS. 1(A) and 1(B). In this immersion nozzle, the bottom shape of the vertical bore was formed to be hemispheric so as to simplify the test condition.

The simulated actual size nozzle for casting the molten steel had dimensions of a vertical bore diameter of 92 mm, an exit port diameter on the side wall of the nozzle of 70 mm, flowing out direction (α) of the exit port of 5 to 35 degrees downward, a gap opening (w) of the bottom slit of 10 to 40 mm, a spread angle (β) in the width direction of 80 to 180 degrees, and a vertical distance of disconnecting region between the exit ports and the bottom slit of 20 to 60 mm.

Figure 21:
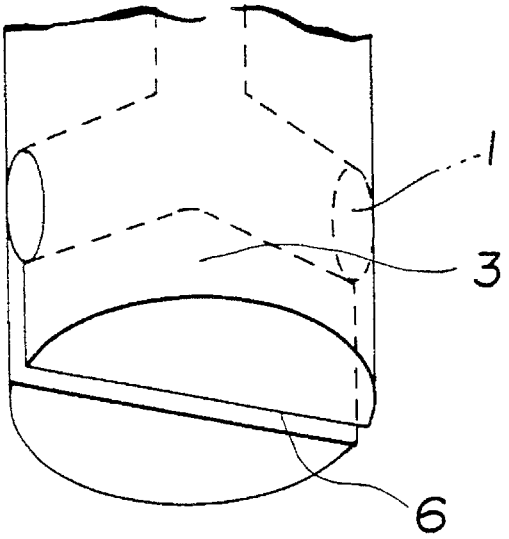
FIG.21 (PRIOR ART)
FIG. 21 illustrates a prior art two-exit port nozzle with connected slit having an angle portion.
Figure 22A:
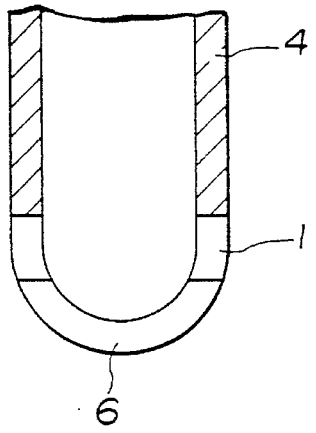
FIG.22(A) (PRIOR ART)
FIGS. 22(A) and 22(B) illustrate a prior art two-exit port nozzle with connected slit.
Figure 22B:
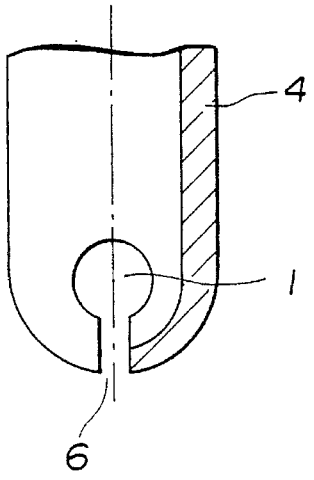
FIG.22(B) (PRIOR ART)

For comparison, a test was carried out using a prior art two-exit port nozzle with connected slit (nozzle dimensions were the same with those of the test nozzle of the invention) having an angle-shaped bottom of the vertical bore (R1, FIG. 21), a hemispherical shape bottom (R2, FIGS. 22(A) and 22(B)) under the casting condition corresponding to the slab width of 1200 to 1240 mm, the thickness of 220 mm, and the casting speed of 1.8 to 2.4 m/minute. Table 1 shows the condition of individual nozzles and the observed results of the test (⊙ mark is given the results to be good and X mark is given the results to be bad).

steel surface in the vicinity of the shorter side to induce a fluctuation of surface level (d) of the molten steel. At the same time, a surface layer flow speed from the mold shorter side to the immersion nozzle increased. On the other hand, the other mold shorter side resulted in a lack of surface layer flow speed, which was observed in prior art two-exit immersion nozzles and which is called an unbalance flow phenomenon of the molten steel in the mold.

Figure 3:
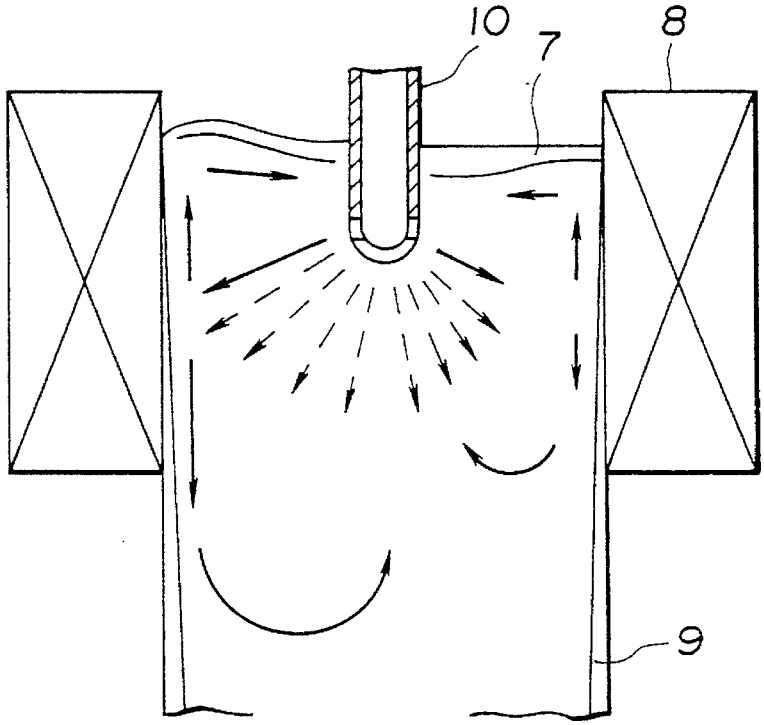
FIG. 3 illustrates a flow pattern of molten steel in a mold with a prior art two-exit ports nozzle with connected slit.
Figure 4:
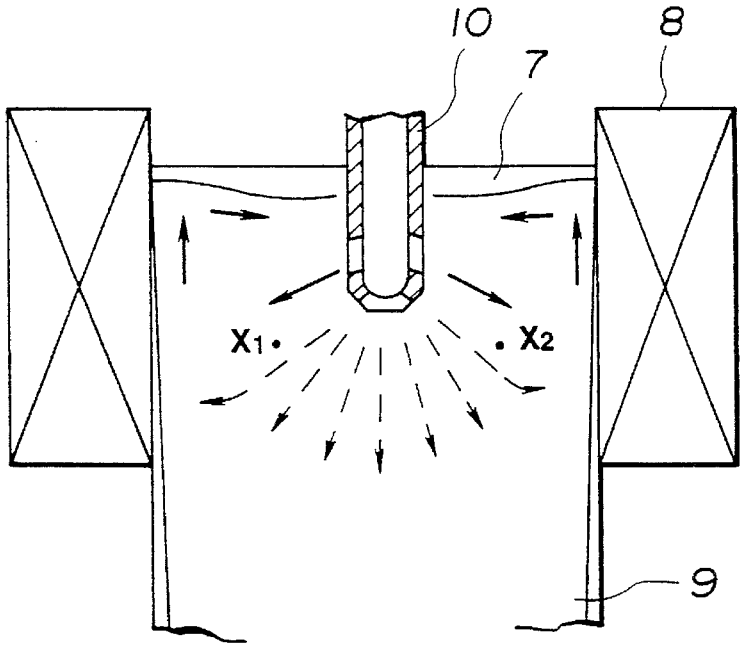
FIG. 4 illustrates a flow pattern of molten steel in a mold with an immersion nozzle of the present invention.

FIG. 3 illustrates an observation result of a flooring out state of the molten steel through the comparative immersion nozzle R2 which has a connection between the side wall exit ports and the bottom slit. FIG. 4 shows an observed result of a molten steel flow inside of the mold and of surface layer flow at the surface in the mold, using an immersion nozzle of the invention. As for the observed result on R2 nozzle, the discharge rate of the molten steel was predominant on one side exit port than the other side, and a phenomenon (b) inducing a different flow rate between the left and right exit ports and a phenomenon (d) of fluctuation of the surface level of the molten steel in the mold were observed.

When the immersion nozzle of the invention was used to observe the molten steel flow in the mold and the surface layer flow on the surface of the molten steel in the mold, the discharge of the molten steel through the exits ports was equal for both left and right exit ports, and no unbalance flow was observed. In addition, the surface level fluctuation of the molten steel in the mold was maintained in a desired stable range of from 2 to 6 mm as a whole, though an abnormal surface level fluctuation of the molten steel occurred under an inadequate condition of the direction of the exit port (α)

and of the spread angle (β) of the bottom slit in the width direction.

The flow speed of the molten steel in the vicinity of the exit ports on the side wall of the nozzle in the mold was determined by miniature propeller flow speed detectors. The phenomenon of unbalance flow at various points of the immersion nozzle of the invention and of the comparative R2 nozzle was observed on the casting condition corresponding to a casting speed of 2.4 m/minute.

Figure 5:
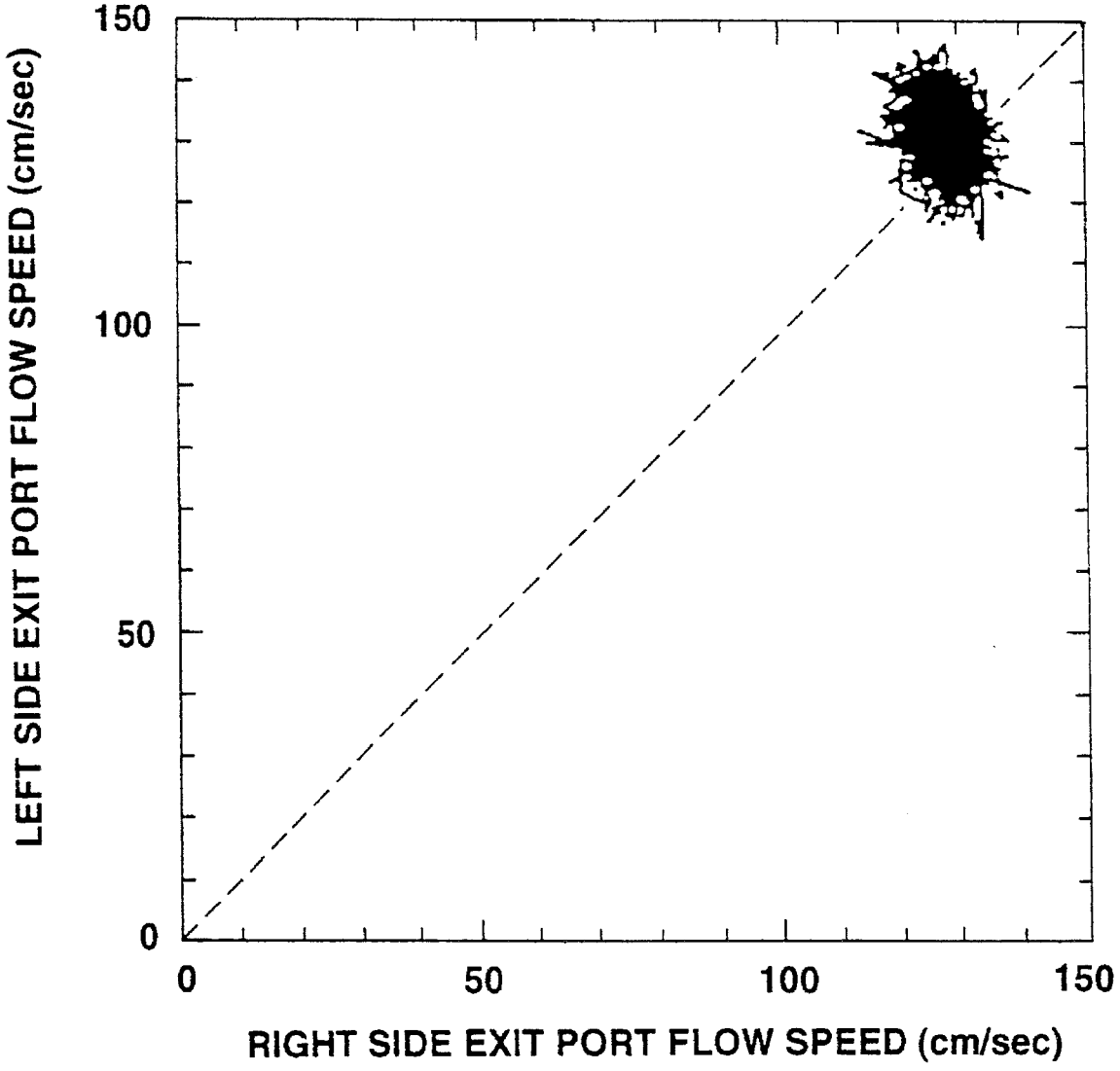
FIG. 5 is a graph comparing flow speed of molten steel through each of right and left exit ports in an immersion nozzle of the present invention.
Figure 6:
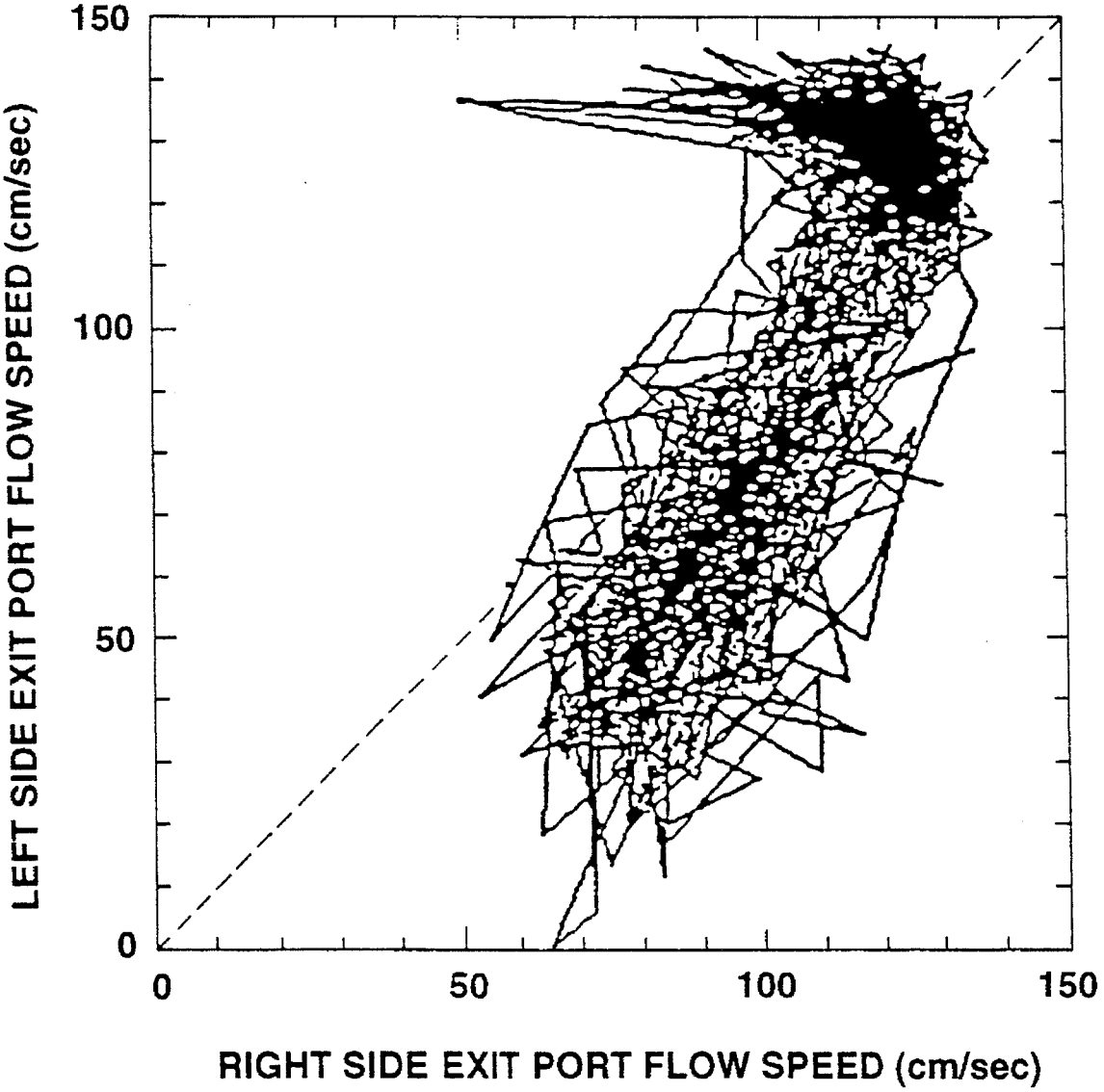
FIG. 6 is a graph giving flow speed of molten steel through right and left exit ports using a prior art two-exit ports nozzle with connected slit.

Examples of the measured data are shown in FIG. 5 and FIG. 6. The flow speed near the exit ports of the immersion nozzle of the invention (FIG. 5) maintained a stable region at around 130 cm/sec on both exit ports. The nozzle R2 (FIG. 6), however, generated a significant unbalance of the flow speed owing to the unbalance flow.

From the comparison of the above-described immersion nozzle of the invention and the comparative R2 nozzle, it was confirmed that when the exit ports and the bottom slit were disconnected to separate each other, the unbalance flow of the molten steel flowing out through the exit ports on the side walls of the nozzle was prevented. When the distance between the exit ports and the bottom slit was secured at 20 mm or more considering the strength of refractory, an effect to prevent an unbalance flow of the molten steel from flowing out through the exit ports appeared, and when the distance was taken as 60 mm, the perfect prevention of the unbalance was achieved.

The description is given below on the observation of interference (c) outside of the nozzle occurring on the molten steel flowing out from the exit ports at the side wall of the nozzle and that flowing out from the bottom slit. The group A (see Table 1) using the immersion nozzle of the invention having a spread angle of 100 degrees or more at the bottom slit gave a fan shaped flat flow pattern.

Figure 7:
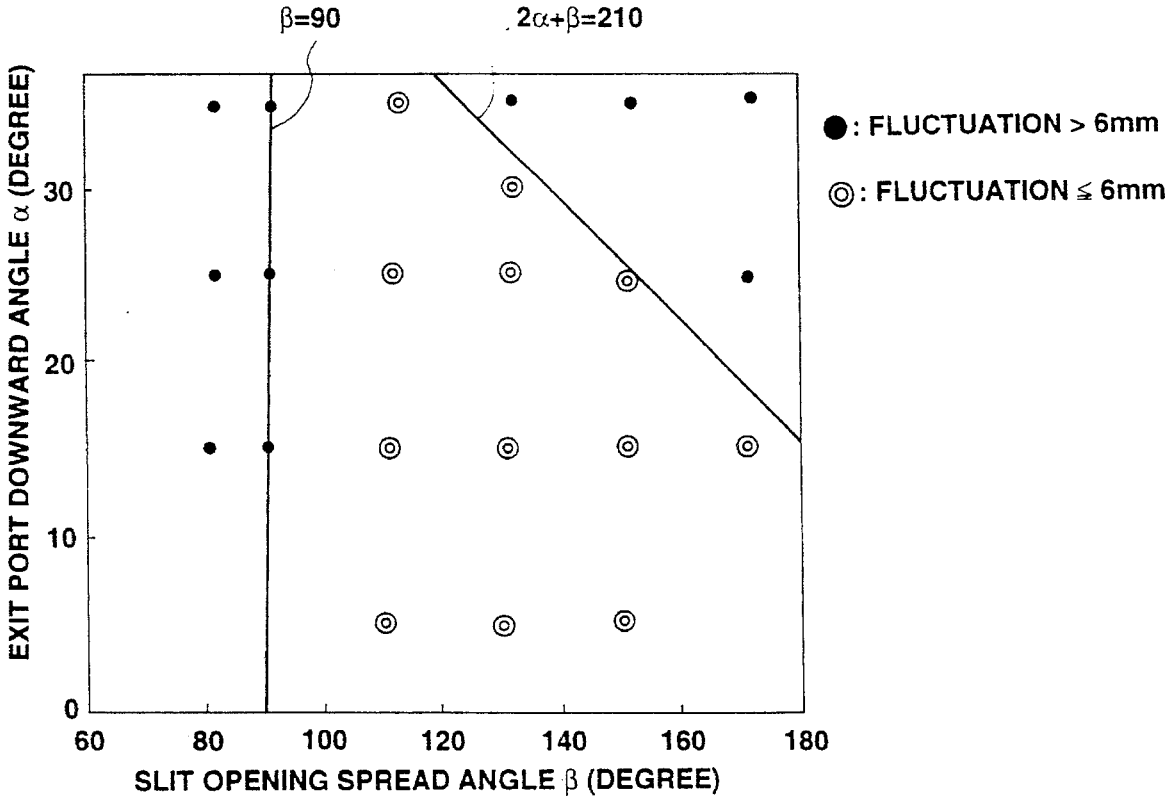
FIG. 7 is a graph showing an optimum range of discharge angle and the slit spread angle in an immersion nozzle of the present invention.

The nozzles of the groups B through F (see Table 1) have the spread angle of the bottom slit at 100 degrees or more. It was found that a preferable condition between the direction of the exit ports (α) and the spread angle (β) in the width direction on the bottom slit was $2\alpha>210-\beta$. Accordingly, in a range of $2\alpha>210-\beta$, the fluctuation of the surface level of the molten steel in the mold became significant, as shown in FIG. 7. The reason for the phenomenon is that the molten steel flowing out through the exit ports and the edge of the fan shaped flat pattern of the molten steel discharged from the bottom slit compete with each other, and that the molten steel through the exit ports apparently becomes predominant.

To study the interference between the flow from the exit ports of the side wall and the flow from the bottom slit, a water model was used to simulate the flow within the mold. The test condition simulated the casting condition of the cast width 1200 mm and drawing speed 2.4 m/minute and an adequate nozzle was selected from the group D (see Table 1) of the invention having $\beta=150$, and an inadequate nozzle was selected from the group C having $\beta=150$.

Figure 8:
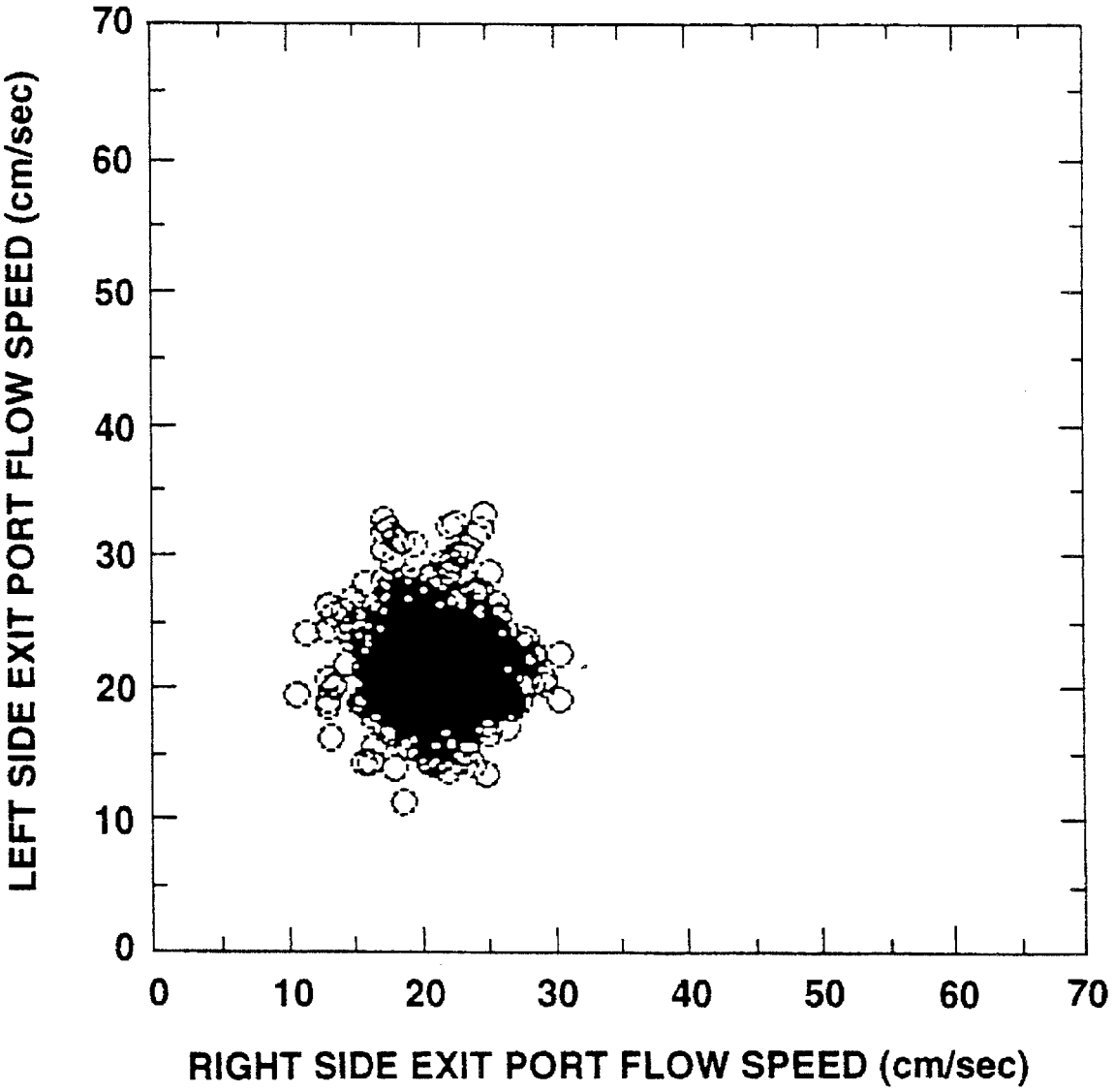
FIG. 8 is a graph comparing the flow speed at the points of $X_1$ and $X_2$ on a nozzle of group D with $\beta$=150 degree, given in Table 1.
Figure 9:
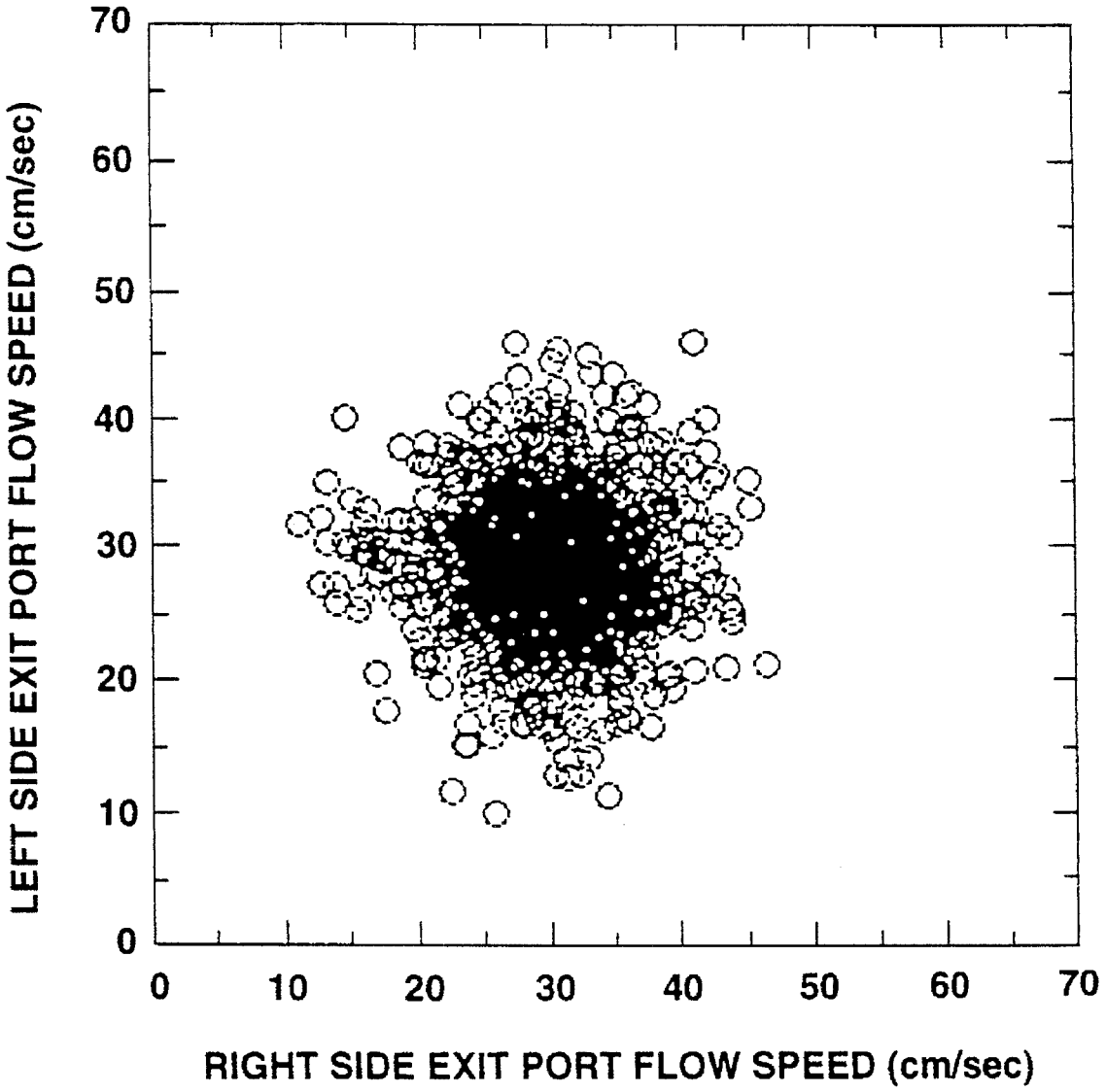
FIG. 9 is a graph comparing the flow speed at the points of $X_1$ and $X_2$ on a comparative nozzle of group C with $\beta$=150 degree, given in Table 1.

Aluminum powder tracer was added from the top of the immersion nozzle, and the locus of the molten steel flowing out from the exit ports of the side wall and from the bottom slit was observed based on the flow behavior of the molten steel. In the case of the adequate nozzle, the flow state becomes the one shown in FIG. 4. In the case of the inadequate .nozzle, however, the flow from the exit ports of the side wall and the flow from the bottom slit interfered with each other. The tangential speed of a locus of flow from the side wall exit ports opened at 300 mm from the center of the mold to width direction was determined using a propeller flow speed detector. The position of the exit ports was indicated by $X_1$ and $X_2$ in FIG. 4, which is 300 mm to the left and right from the center of width of the mold, and 250 mm from the lower edge of the exit ports of the nozzle at the center of the width of the mold. The observed results are shown in FIG. 8 and FIG. 9. The horizontal axis is the flow speed at right side ($X_2$), and the vertical axis is the flow speed at left hole ($X_1$). Although the flow speed appeared on the adequate nozzle (FIG. 8) stabilized at around 23 cm/sec on both left and right sides, that on the inadequate nozzle (FIG. 9) showed a dispersed flow speed giving a higher average speed than that of the adequate nozzle.

Large absolute values and large dispersions at the measured points mean large absolute values and large dispersions in the upflow after impinging against the short side, which finally results in large absolute values and large dispersions of the surface flow speed.

From the finding, in the case where an interference appears, or where $2\alpha+\beta>210$ is satisfied, the surface flow speed increases, which causes the powder inclusion.

Even when the above-described phenomenon appears, the immersion nozzle of the invention induces that phenomenon on both left and right sides at a time. Consequently, different from the phenomenon seen in the prior art immersion nozzle, the degree of fluctuation of the surface level of the molten steel in the mold increases and the degree is in the same magnitude on the left and right short sides in the mold. In addition, the dispersion of the molten steel flow in a fan shaped flat pattern discharged from the bottom slit into the sheet thickness direction, or the thickness direction in the mold is affected by the thickness of the nozzle bottom to form the slit gap, or the thickness (t) of the slit inner wall along the direction of discharge. Actually, 10 mm is sufficient for the thickness to maintain the strength of refractory at the bottom of the nozzle.

Since the inner walls at the slit gap form parallel planes facing each other, the molten steel flows out through the bottom slit in a fan shaped flat pattern. Nevertheless, to ensure a fan shaped fiat pattern of the molten steel flow at every section in the slit width direction in the mold, it is preferable to select the t value at every portion of the width direction of the mold equal to each other or to select the variation ratio of thickness at 2.5 or less. However, the function to spread the molten steel flowing out through the bottom slit into a fan shaped flat pattern in the width direction of the mold is achieved by the shape of the vertical bore bottom opening to the bottom slit, not by the outer shape of the bottom. The required condition is that the inner face is downward convex symmetrically in with width direction.

The result of the test is described in terms of the gap dimension of the bottom slit. At a gap dimension of 40 mm, the contribution of an inside (static) pressure is weak and no slit effect appeared. So the molten steel flowing down through the vertical bore tended to flow out from a part of the bottom slit in a thick downflow stream. However, when the gap dimension was decreased from 30 mm to 20 mm, the flow from the bottom slit was improved into a fan shaped flow spread in the width direction in the mold.

The minimum dimension of the slit gap is not determined from the flowing out shape. The minimum dimension of the slit gap is necessary to have approximately 10 mm because there are other factors in actual casting, for example, alumina inclusion may adhere to the bottom slit opening. Accordingly, the opening gap of the bottom slit is selected based on the product of the gap and the length of the slit, or the cross sectional area of the opening, depending on the charge amount of the molten steel. Nevertheless, a satisfactory gap is the one which allows to decrease the discharge rate from the bottom slit to a degree generating a molten steel pressure at the slit opening on inner face of the immersion nozzle.

When the contribution of the inside (static) pressure is weak, the effect of dynamic pressure induced by the molten steel flow inside of the nozzle becomes predominant, and the molten steel flows out through a part of the bottom slit. Accordingly, the flow may not form a uniformly spread fan shaped flat pattern. An optimum gap dimension for a certain casting condition can be determined by a water model test.

Example 2

To study the interference between the flow from the side wall exit ports and the flow from the bottom slit, the flow inside of the mold was observed using a water model. The casting conditions applied corresponding to the mold width 1200 mm and the drawing speed 2.4 m/minute. The basic type of the immersion nozzle was a nozzle of group D (see Table 1) having $\beta$=150, varying the partition wall dimension to five levels, 0 (slit-connecting type), 10, 20, 30, and 50 mm. The evaluation of the unbalance was carried out by measuring the change of flow speed in the mold with time and by determining the standard deviation.

Figure 10:
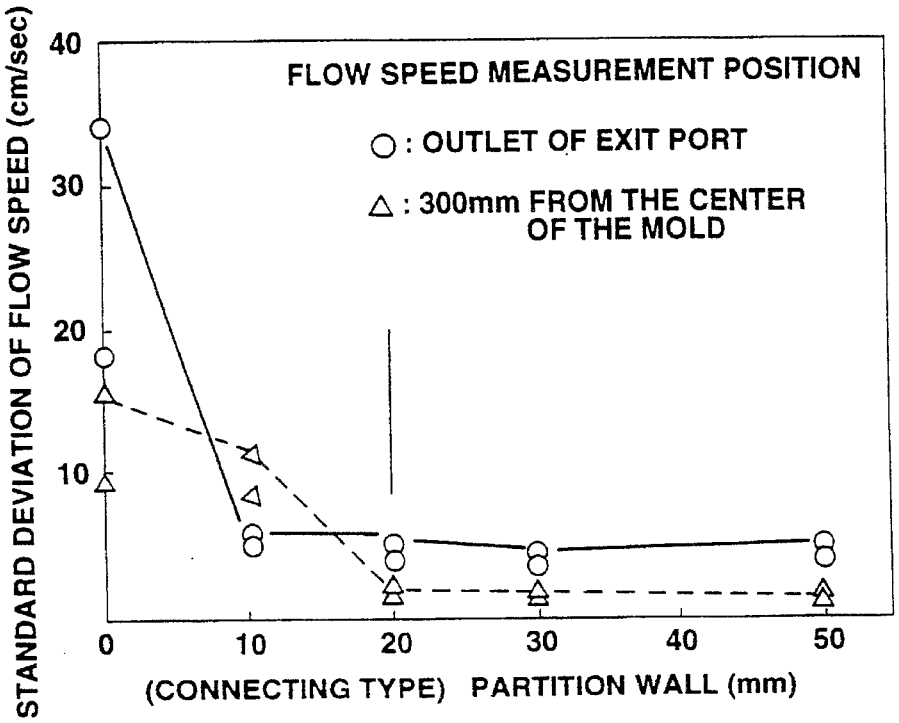
FIG. 10 is a graph showing a fluctuation of flow speed at and near the exit port with varied distance between the lower edge of the exit port and the upper edge of the bottom silt opening.

The discharge flow speed from the left and right exit ports was measured. The positions of measurement were the exit port opening and the $X_1$ or $X_2$ described above. The result is shown in FIG. 10. When the partition wall dimension was 0 (the side wall exit ports and the bottom slit were connected to each other), the standard deviation was large giving 34 cm/sec, which suggested there were significantly high fluctuations. On the other hand, when the partition wall dimension was selected as 10 mm or more, the standard deviation became 5 cm/sec or less, which suggested that the discharged flow was quite stable. The phenomena showed that the partition wall eliminated the effect of dynamic pressure generated in the nozzle vertical bore.

Aluminum tracer was added from the top of the immersion nozzle to determine the locus of flow coming out from the side wall exit ports. The locus was found being not much affected by the partition wall dimension. Consequently, the tangential speed of a locus of flow coming out from the side wall exit ports at 300 mm point in the width direction of the mold was determined by a propeller flow speed detector. The result is shown in FIG. 4. When the dimension of the partition wall was 10 mm or less, the standard deviation became 10 cm/sec or more, which suggested that the flow was unstable. This presumably came from the interference between the flow from side wall exit ports and the flow from the bottom slit. When the partition wall dimension was selected as 20 mm or more, the fluctuation became small, and no interference occurred.

From the results described above, a preferable dimension of the partition wall is 20 mm or more to avoid the effect of dynamic pressure in the vertical bore and to avoid the interference between the flow from the side wall exit ports and the bottom slit.

Example 3

A nozzle having the bottom slit spread angle $\beta$ of 130 degree was prepared based on the group D nozzle in Table 1 and a comparative nozzle of R2, an actual nozzle, was also prepared. Those two types of nozzles, along with a prior art two-exit port nozzle, were used to carry out the casting in commercial equipment under the same condition with the water model test. The studied items were the surface level fluctuation of the molten steel in the mold, and the surface quality of cold rolled thin steel sheet obtained from the cast slab. The immersion nozzles used alumina-carbon as the material.

The cast steel was an aluminum-killed steel prepared from molten steel in a converter and was adjusted in its composition in an RH vacuum degassing unit to be C≦0.05%, Si≦0.03%, Mn≦0.30%, P≦0.03%, S≦0.02%, and sol.Al≦0.20 to 0.40% by weight. The charge of the molten steel from a ladle to a tundish was carried out using an air-seal pipe. The tundish was lined with a magnesia insulation board inside thereof. Argon gas was introduced to a space between the tundish cover and the inside molten steel surface to prevent secondary oxidation. The temperature of the molten steel in the tundish was maintained in a range of from 1560° to 1545° C. to enhance the floatation separation of inclusion of the molten steel in the tundish.

The casting of the molten steel into the mold was carried out using a sliding nozzle molten steel flow rate control unit and an immersion nozzle. With a molten steel surface level controller in the mold, the surface level of the molten steel was maintained stably at a constant level of 100 mm or less from the upper end of the mold. At the same time, argon gas was introduced to the inside of the sliding nozzle and the immersion nozzle at a rate of 9 l/minute to prevent adhesion of alumina inclusion onto the inside wall surface of the vertical bore. The mold powder used was the one for a low carbon aluminum-killed steel casting.

As for the measurement of the surface level fluctuation of the molten steel in the mold, a non-contact surface level meter of a vortex distance meter type was installed at the top of the mold. The measurement was conducted at the maximum fluctuation of the surface level in the vicinity of left and right short sides of the mold. The measured data signals obtained on the left and right measurement points were continuously recorded on a multi-channel data recorder. For analytical purpose, the difference of the surface level fluctuation on both left and right measuring points were recorded at the same time for quantifying the unbalance phenomenon.

Figure 11:
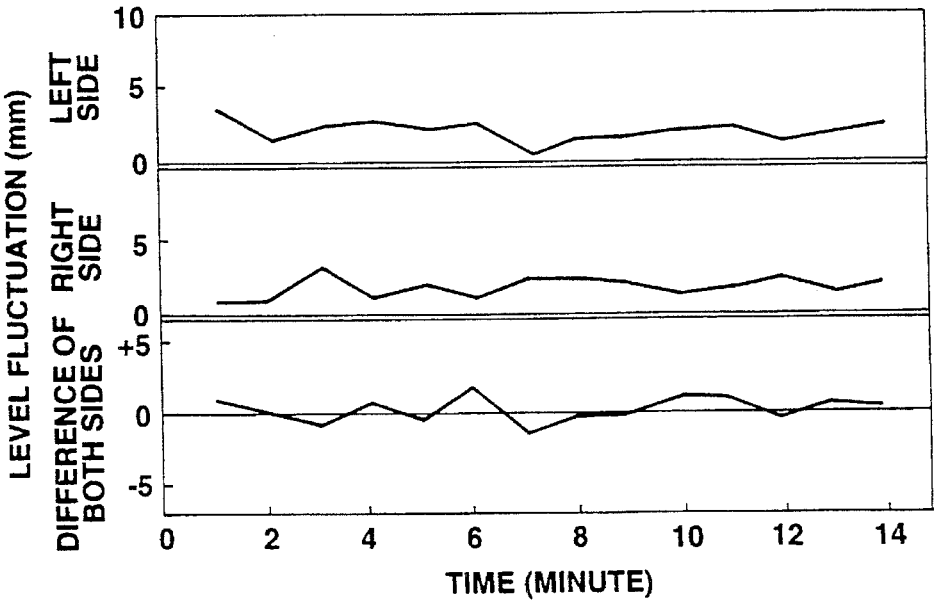
FIG. 11 is a graph showing melt level fluctuation in the mold using an immersion nozzle of the present invention.
Figure 12:
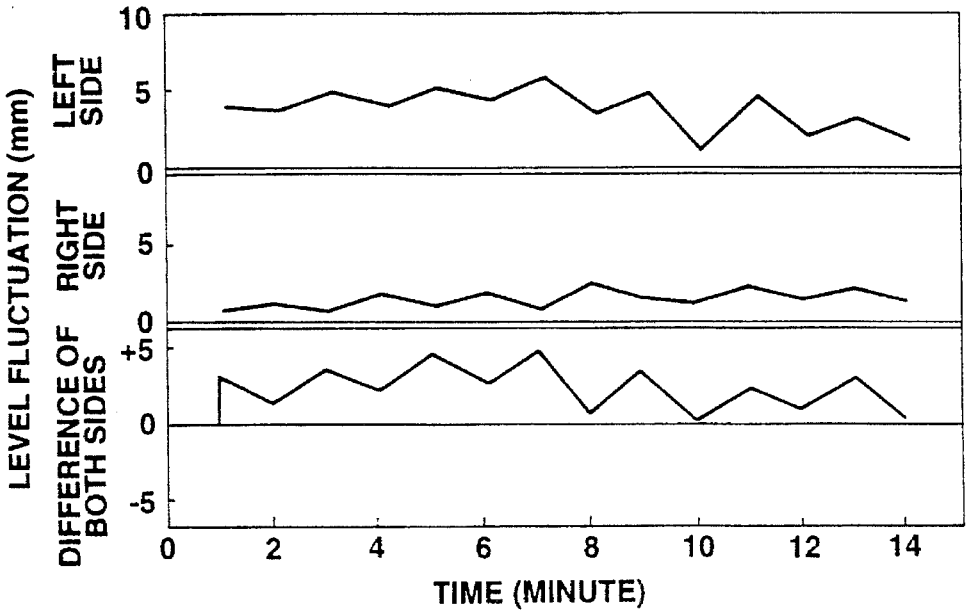
FIG. 12 is a graph showing level fluctuation in the mold using a prior art two-exit port nozzle with connected slit (R2, given in FIG. 22)

FIG. 11 and FIG. 12 show examples of the surface level fluctuation during the casting time of 14 minites for each of the immersion nozzles of the invention (D group, $\beta$=130 degree) and a comparative R2 nozzle. The magnitude of the surface level fluctuation of the immersion nozzle of the invention was within a range of from 1 to 4 mm for each of the left short side and the right short side of the mold, and the difference of the surface level fluctuation between the left and right sides at the same time was also within ±1 to 2 mm. (see FIG. 11.) On the other hand, the difference of the surface level fluctuation between the left and right sides was changed with time within a range of from 0 to 5 mm with the R2 nozzle, which suggested the presence of unbalance flow(FIG. 12.).

Figure 13:
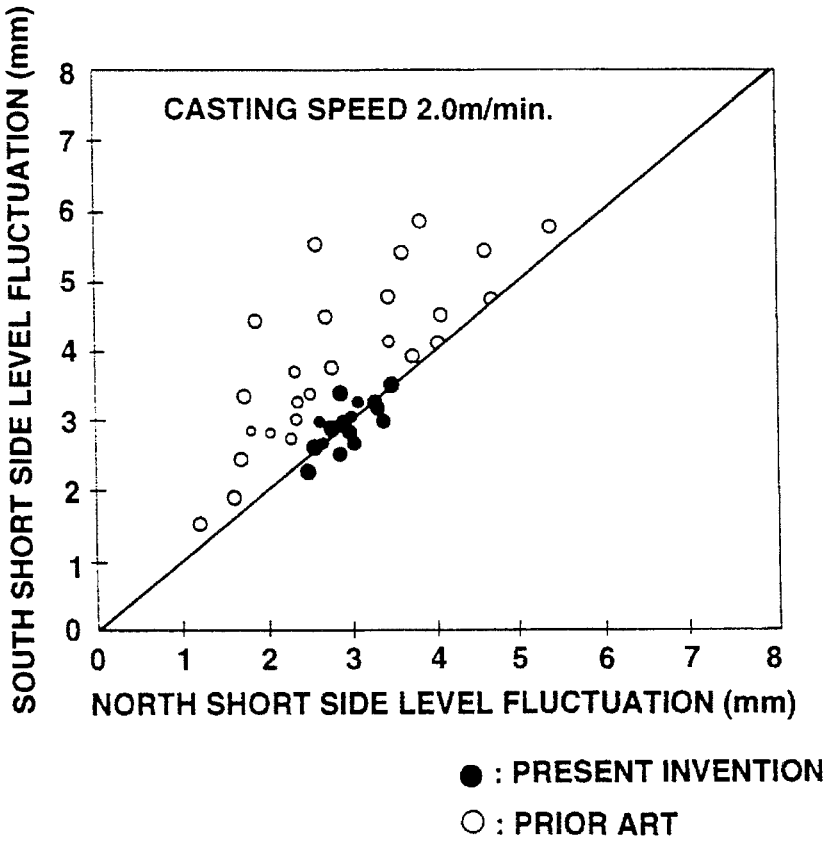
FIG. 13 is a graph comparing level fluctuation at both short sides for a prior art two-exit port nozzle with connected slit and an immersion nozzle of the present invention.

FIG. 13 shows a comparison of measured data of the surface level fluctuation of the molten steel on the left short side and the right short side of the mold. Also in the measurement, the immersion nozzle of the invention gave the observed values on both left and right sides stayed at near 3 mm which was an adequate level. On the other hand, the prior art two-exit port nozzle gave the surface level fluctuation in a range of from 1.5 to 5 mm giving the maximum difference between the left side and the right side at approximately 3 mm. To confirm the surface quality improvement on a cold rolled thin steel sheet, a two-strand continuous casting machine was operated. The immersion nozzle of the invention was installed in a mold of one side of the machine, and the prior art two-exit port nozzle was installed in another mold of the other side of the machine. The casting was conducted under two levels of casting speed, 2.0 m/minute and 2.4 m/minute during the same heat casting, and the cast slab was rolled to a 2.5 mm thick hot rolled coil without maintenance cleaning.

After picking the surface of the prepared coil, the coil was rolled by a cold rolling mill to a cold-rolled thin steel sheet having a thickness of 0.7 mm. The surface of the coil was visually inspected on both sides over the whole length in a coil inspection line. Among the observed surface flaws, scab defects caused by alumina inclusion and by mold powder were further analyzed under a scanning electron microscope to check the presence of $Al_2O_3$, CaO, $Na^+$ etc. The expression of the number of defects used the scab defect rate (%) which was determined by the product of the number of scab defects and the standard length per defect divided by the total length of the coil and multiplied by 100.

Figure 14:
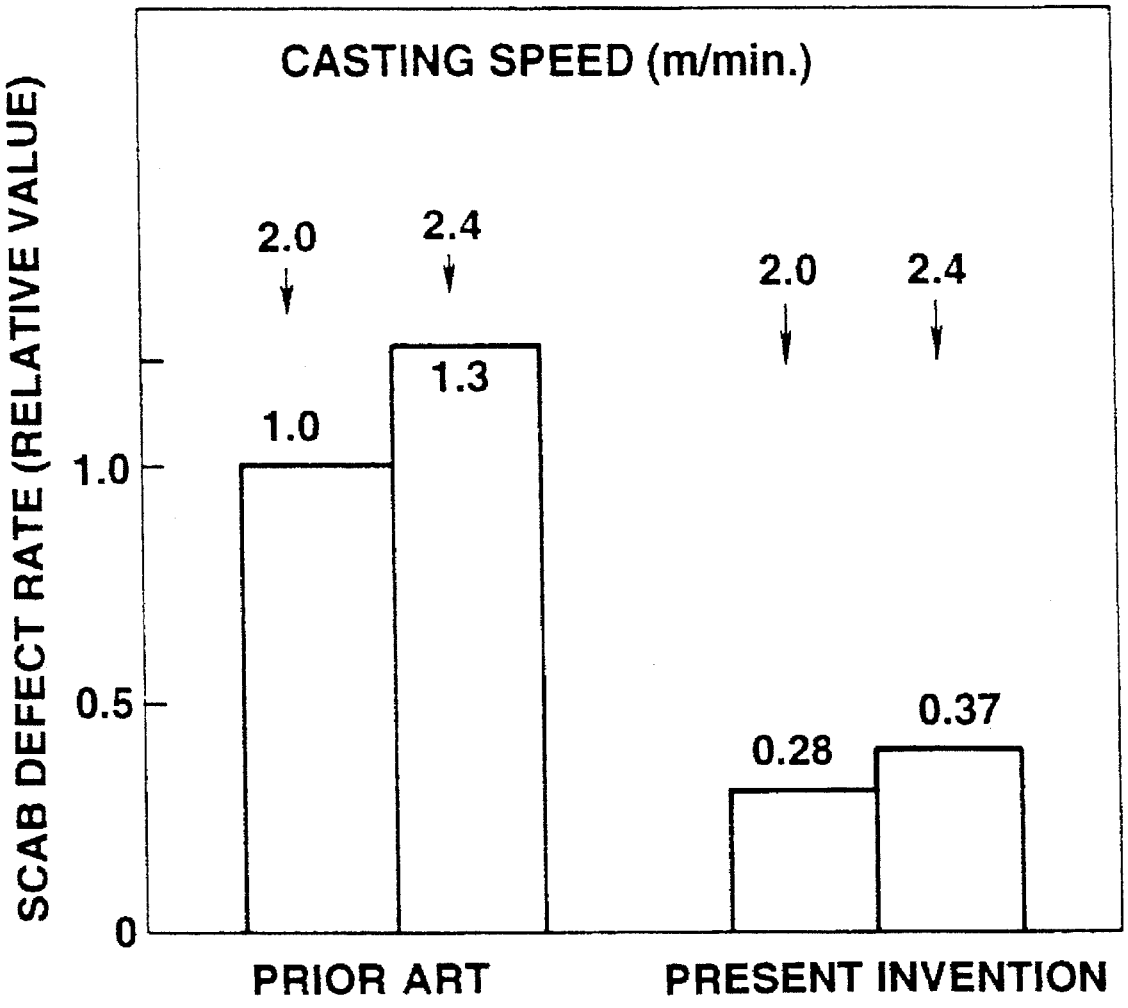
FIG. 14 is a graph comparing defect rate on each cold-rolled coil obtained by rolling an ingot using a conventional two-exit port nozzle with connected slit and an immersion nozzle of the present invention.

FIG. 14 shows the result of the test using a relative index selecting the scab defect rate on a cold rolled coil which was cast at a casting speed of 2.0 m/minite with a prior art immersion nozzle as the standard rate (1.0). The relative index of defect rate for the comparative example using a casting speed of 2.4 m/minute was 1.3. The relative indexes on the cold- rolled coil using the immersion nozzle of the invention gave 0.4 or lower value for both casting speeds.

From the above-described study, it was found that the application of an immersion nozzle of the present invention to a commercial continuous casting line improved the unbalance flow of the molten steel, which was a disadvantage of the prior art two-exit port nozzle with connected slit, and that an optimum fluctuation range of the surface level of the molten steel in the mold was obtained and that an optimum fluctuation range of the surface level of the molten steel in the mold was secured even under a high speed casting at 2.0 m/minte or above, and that the produced steel sheet further improved the surface quality level of the prior art.

Example 4

With the immersion nozzles of the present invention which had three different reduction styles of nozzle cross section and which were made of alumina-carbon, a five-heat continuous casting was carried out for each of the nozzles in a commercial casting machine under the condition of slab width ranging from 1200 to 1240 mm, thickness of 220 mm, and casting speed ranging from 2.0 to 2.4 m/minute. The surface level fluctuation caused by the adhesion of alumina inclusion was studied and the inside surface of the nozzle was observed after casting operation to compare the state of adhered alumina inclusion in each nozzle.

All the applied immersion nozzles of the invention were the ones belonging to the group D given in Table 1, which had the spread angle of the bottom slit $\beta$=130 degree, the slit gap w=30 mm, the exit port angle $\alpha$=25 degree, and the diameter of exit port opening of 60 mm. Table 2 shows the nozzles with another reduction style of cross section. Table 2 also gives the observed result of the attached alumina inclusion on the inside surface of the nozzle and the surface level fluctuation of the molten steel in the mold. The symbols are: (◎) for favorable state, (○) for not favorable but applicable, and (X) for inapplicable.

TABLE 2

| Type of Immersion Nozzle | Style of Reduction of Vertical Bore Cross Section Inside of Nozzle: Top Portion Cross Section | Bottom Cross Section & Bottom Shape | From Top to Exit Port | From Exit Port to Bottom | Alumina Inclusion on Inside Wall: From Top to Bottom | From Exit Port to Bottom | Level Fluctuation of Molten Steel, Number of Cast: 1–2 | 3–5 |
|---|---|---|---|---|---|---|---|---|
| S1 | Circular 92 m ϕ | Circular 92 m ϕ Hemisphere | Non-Reductioon | Non-Reductioon | X | X | ◎ | ○ |
| S2 | Circular 92 m ϕ | Flat Ellipse Parabola | Non-Reductioon | Reduction with Enhanced Flatness of Ellipse | X | ◎ | ◎ | ◎ |
| S3 | Circular 92 mm ϕ | Flat Ellipse Parabola | Reduction From Circular to Ellipse | Reduction with Further Enhanced Flatness of Ellipse | ◎ | ◎ | ◎ | ◎ |

X: Presence of inclusion
◎: Absennce of inclusion

The immersion nozzle S1 given in Table 2 was a type having the inside shape of FIGS. 2(A) and 2(B), which had a vertical bore of straight cylindrical shape with a diameter of 92 mm and which had a hemispherical bottom face of the vertical bore. The immersion nozzle S2 given in Table 2 was a type having the inside shape of FIGS. 1(A) and 1(B), which had a vertical bore of straight cylindrical shape with a diameter of 92 mm from the top to the exit ports. The vertical bore from the exit ports to the bottom had a horizontal cross section of quasi-ellipse having a major axis parallel to the bottom slit and having a minor axis being reduced in length proportional to the downward distance to reduce the cross sectional area of the vertical bore toward the bottom slit.

Figure 15A:
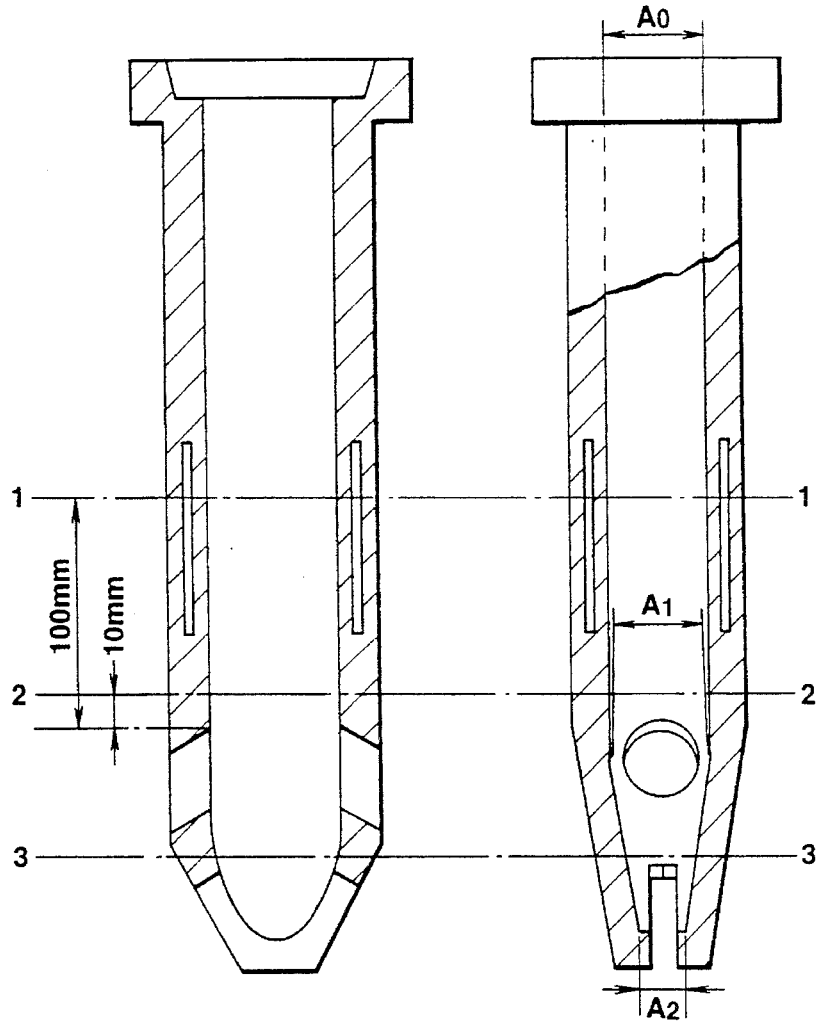
FIGS. 15(A) and 15(B) show a shape of an S3 nozzle of the present invention along with the points of measurement for flow speed inside of the nozzle.
Figure 15B:
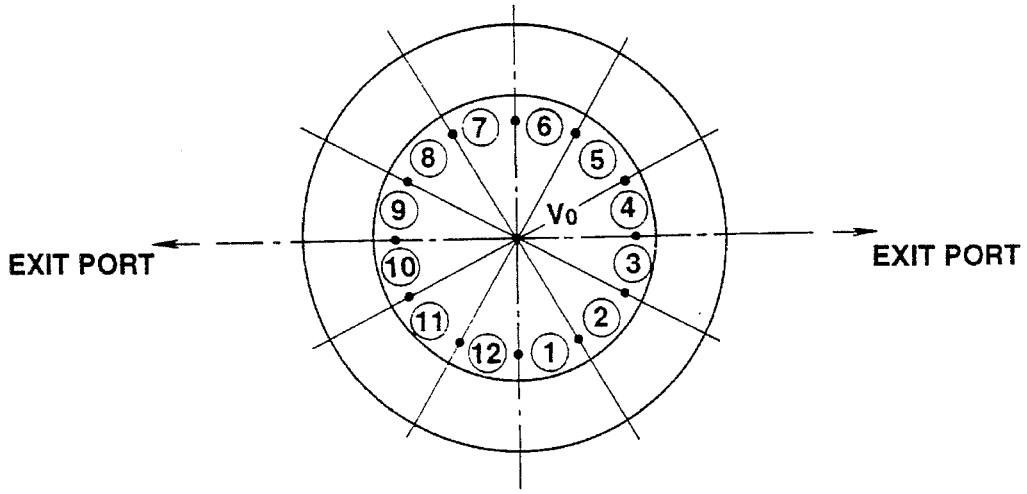

The cross section parallel to the width of the mold across the nozzle center axis in the vertical bore drew a downward convex parabola, and the inside opening of the bottom slit was on the parabola face. The immersion nozzle S3 in Table 2 is the one given in FIGS. 15(A) and 15(B), which had a circular cross section at the top of the vertical bore and which had a portion down to the exit ports having a cross section of major axis of 92 mm parallel to the bottom slit opening. And the minor axis was gradually reduced from 92 mm to 64 mm to form an ellipsoidal cross section. The cross section ranging from the exit ports to the bottom was reduced toward the slit at the bottom of the vertical bore as in the case of S2 nozzle described above. The inside opening of the bottom slit was on the downward convex parabola at the bottom of the vertical bore.

Example 5

To investigate the preventive effect to the alumina adhesion by the change of nozzle inside wall shape, a full scale water model experimental apparatus was used for determining the flow speed distribution inside of the immersion nozzle. The reduction ratio of the immersion nozzles applied is listed in Table 3. The dimensions of nozzle S1 were $A_1$=66.4 cm$^2$, $A_0$=66.4 cm$^2$, $A_2$=61.9 cm$^2$, $X_1$=7.5 cm. The shape of nozzle S3 is given in FIG. 15(*a*). The dimensions of nozzle S3 were $A_0$=66.4 cm$^2$, $A_1$=46.22 cm$^2$, $A_2$=32 cm$^2$, $X_1$=7.5 cm.

Figure 16:
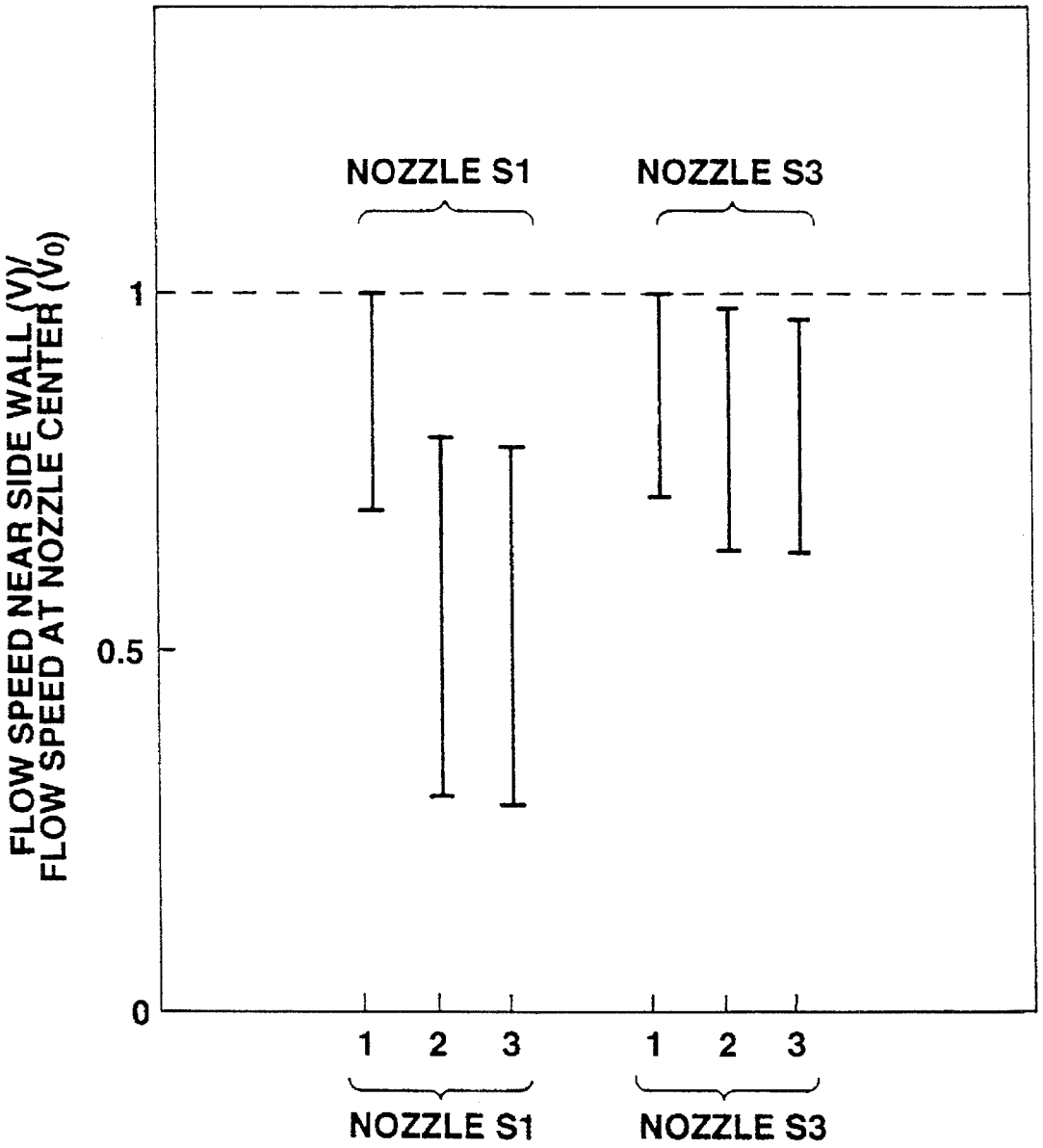
FIG. 16 is a graph comparing flow speed distribution at each cross section inside of an S3 nozzle of the present invention and an S1 comparative nozzle.

The flow speed measurement was conducted at three cross sections: the cross section 1 (100 mm above the upper edge of the side wall exit ports), the cross section 2 (10 mm above the upper edge of the side wall exit ports), and the cross section 3 (center of the distance between the lower edge of the side wall exit ports and the upper edge of the bottom slit), which are shown in FIG. 15(*a*). For each cross section, the measurement was carried out to determine the flow speed $V_K$ (k was 1 to 12) at twelve points which were designated by the number 1 through 12 distant from the wall surface and the flow speed $V_0$ at the nozzle center, (FIG. 15(*b*)). Then, the value of (flow speed in the vicinity of wall)/(flow speed at the nozzle center) was calculated to evaluate the stagnant state. FIG. 16 shows the result. The figure shows the maximum and minimum values of $(V_k/V_0)$ in each nozzle at each nozzle cross section. For the case of nozzle S1, the cross section 1 gave $(V_K/V_0)$ in a range of from 0.7 to 1, but the cross sections 2 and 3 gave the value ranging from 0.3 to 0.8, which suggests that the latter sections had a stagnant zone. As for the case of nozzle S3, the cross section 1 gave the value ranging from 0.7 to 1, which value resembled the nozzle S1. Nevertheless, the cross sections 2 and 3 gave the value ranging from 0.65 to 1, which indicates the elimination of stagnant zone.

With the reduction of horizontal cross sectional area by 70% or more and with the use of the reduction satisfying the relation of $\{(dA/dX)\cdot(X_1/A_1)\}\leqq -0.3$, the occurrence of a stagnant zone on the inside wall surface is suppressed. Therefore, the stagnation is eliminated and the amount of adhered alumina onto the inside wall surface of the immersion nozzle is reduced by changing the nozzle inside wall shape from that of S1 to that of S3.

Consequently, the reduction of nozzle inside diameter reduces the stagnation within the nozzle and prevents the alumina adhesion.

TABLE 3

| Type of Immersion Nozzle | Style of Reduction of Vertical Bore Cross Section Inside of Nozzle: Top Portion Cross Section | Bottom Cross Section & Bottom Shape | From Top Portion to Exit Port | From Exit Port to Bottom | Reduction Ratio: From Top Portion to Exit Port $A_1/A_0$ | From Exit Port to Upper Edge of Slit: Maximum Value of $\{(dA/dX)\cdot(X_1/A_1)\}$ | $A_2/A_1$ |
|---|---|---|---|---|---|---|---|
| S1 | Circular 92 m ϕ | Circular 92 m ϕ Hemisphere | Non-Reduction | Non-Reduction n | 1 | 0.113 | 0.932 |
| S3 | Circular 92 m ϕ | Flat Ellipse Parabola | Non-Reduction | Reduction with Further Enhanced Flatness of Ellipse | 0.696 | −0.308 | 0.692 |

$A_0$: Horizontal Cross Section Area of Vertical Bore at Upper Portion of Nozzle
$A_1$: Horizontal Cross Section Area of Vertical Bore at height of the Center of Exit Port of Nozzle
$A_2$: Horizontal Cross Section Area of Vertical Bore at the Top Edge of Slit
A: Horizontal Cross Section Area of Vertical Bore of Nozzle
X: Vertical Distance from height of the Center of Exit Port of Nozzle
$X_1$: Vertical Distance from height of the Center of Exit Port to Upper Edge of Slit Similar to Example 3, casting was carried out by charging a low carbon aluminum-killed steel for cold rolled thin steel sheet from a ladle to a tundish in a non-oxidation manner to prevent secondary oxidation of the molten steel in the tundish. The temperature of the molten steel in the tundish was maintained in a range of from 1560° to 1545° C. to enhance the floatation separation of inclusion in the molten steel in the tundish.

The casting of the molten steel in the mold was conducted using a molten steel surface level control unit in the mold to maintain the surface level of the molten steel in the mold at 100 mm below the upper edge of the mold, while introducing argon gas at a rate of 9 l/minute into the sliding nozzle molten steel flow rate controller and into the immersion nozzle to prevent adhesion of alumina inclusion on those regions. A mold powder for low carbon aluminum-killed steel was applied on the surface of the molten steel in the mold. The sliding nozzle was a type of two-plate fabricated by high refractory plates having an inner diameter of 80 mm for both stationary nozzle and sliding nozzle.

Regarding the observation of the surface level fluctuation of the molten steel in the mold during the continuous casting machine operation, the first and the second heat in the continuous five heat continuous casting showed an equal surface level fluctuation on both left and right sides of the mold giving the range of fluctuation from 2 to 4 mm for all the nozzles of S1, S2, and S3, and they were ranked as being favorable (◎).

In the casting of third to fifth heat, however, S1 nozzle gave a severe surface level fluctuation of the molten steel and showed a difference of fluctuation between left and right sides in the mold. Nevertheless, S2 and S3 nozzles gave a satisfactory result similar to that in the first and the second heat.

Figure 17:
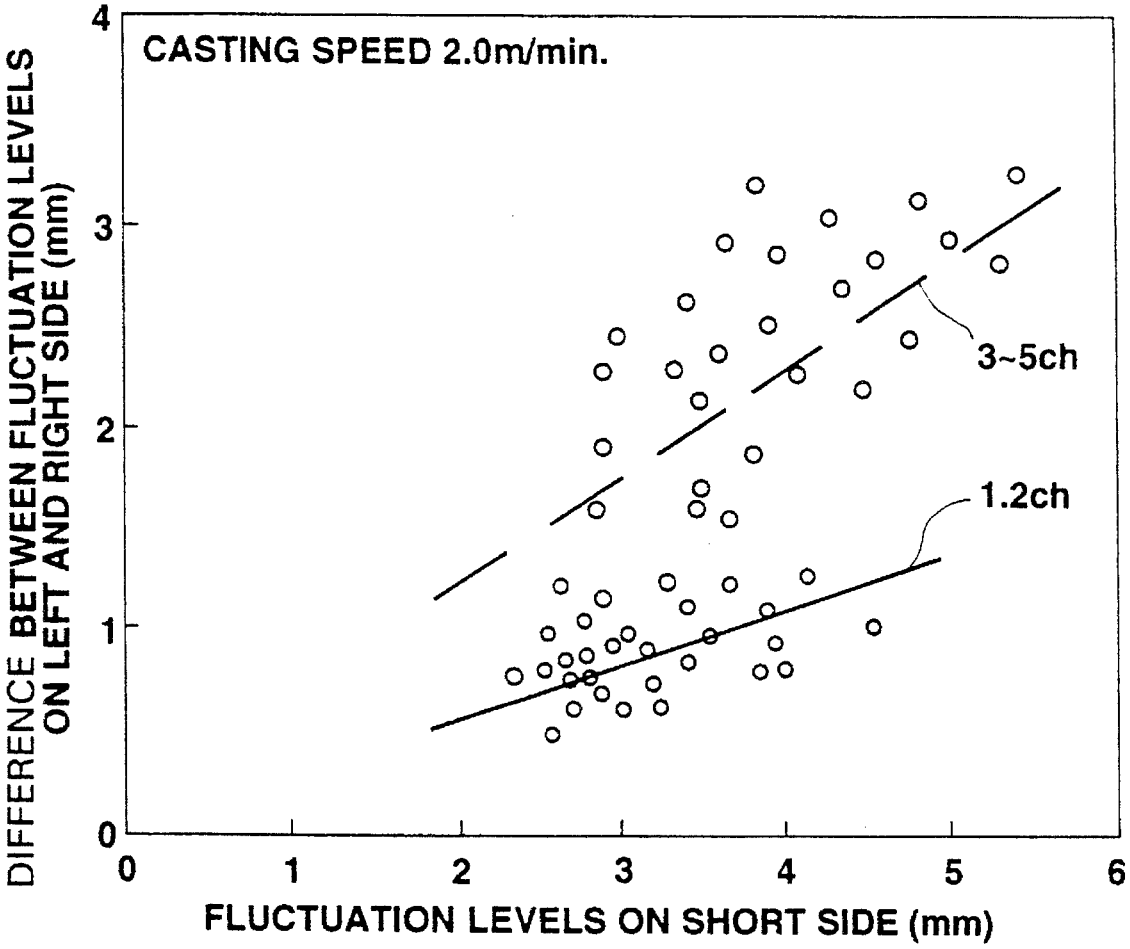
FIG. 17 is a graph giving data of level fluctuation observed during a multi-heat continuous casting using an S1 immersion nozzle of the present invention.

FIG. 17 shows observed result on the surface level fluctuation of the molten steel in the mold with S1 nozzle. The surface level fluctuation in the first and the second heat was in a range of from 2.5 to 4.0 mm with the difference of the fluctuation between left and right sides in the mold of 0.5 to 1.2 mm. However, in the casting of third to fifth heat, the surface level fluctuation increased to a range from 2.3 to 5.4 mm and the difference of fluctuation also increased to a range from 0.8 to 3.3 mm. Although the latter case did not provide a favorable state of surface of the molten metal, the casting was available (with ○ mark).

Figures 18A, 18B:
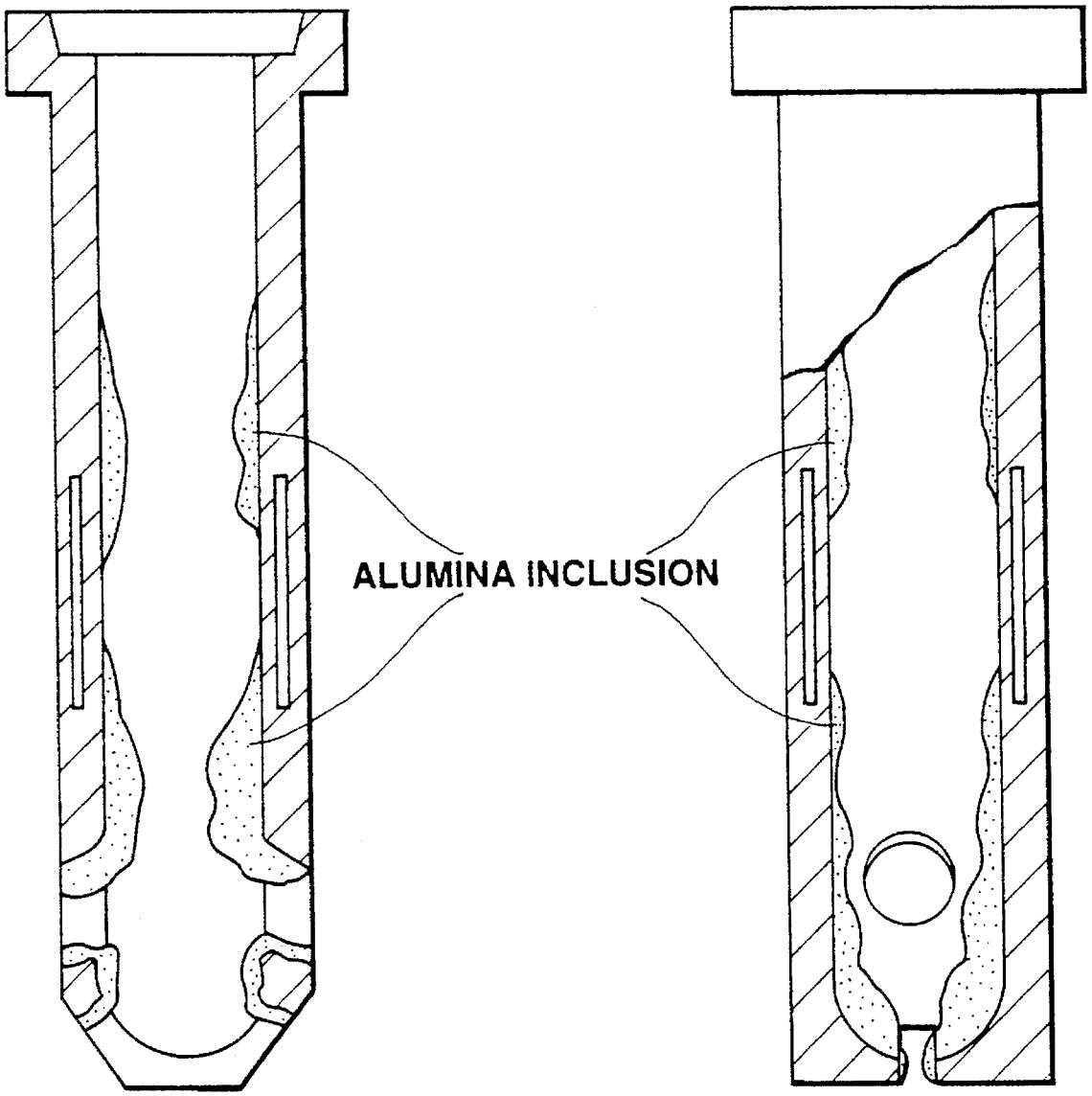
FIGS. 18(A) and 18(B) illustrate a state of adhered inclusion inside of an S1 immersion nozzle of the present invention.

FIGS. 18(A) and 18(B) show the state of alumina inclusion adhered to the inside wall surface of the S1 nozzle, which was observed after the casting operation. In a range of nozzle vertical bore portion, lots of alumina inclusion adhered on the left and right exit port sides, or the inside wall surface corresponding to the short side of the mold of vertical bore, and less alumina inclusion was found on the inside wall surface corresponding to the long side of the mold. On the inside wall surface of a range between the exit port portion and the opening of the bottom slit, a thick alumina inclusion adhered to the zone parallel to the long side of the mold extending down to the inside of the opening of the bottom slit.

Observation of the flow of the molten steel inside of S1 nozzle was conducted in a water model test. The flow of the molten steel from the upper portion of the nozzle to the exit ports formed a single band of stream going down and passing through a part of the cross section of the nozzle unbalancing to either side of the exit ports and flowing down along the wall of selected side. As result, the zone between the other side inside wall and the unbalanced flowing molten steel became a stagnant zone. This unbalance flow phenomenon moved from one exit port to the other alternately with time.

The stream line of the molten steel in a range between the exit ports to the bottom slit opening formed a band stream parallel to the width of the mold toward the slit opening. The zone between the stream and the inside wall parallel to the long side of the mold became a stagnant zone. Since the inside wall portion of S1 nozzle where lots of alumina inclusion adhered coincided with the stagnant zone observed in the water model test, the portion presumably induced a turbulent flow of the molten steel to enhance the growth of alumina agglomeration and induced the adhesion of alumina to the inside wall surface.

Accordingly, it was found that a preferably cross sectional shape of a nozzle vertical bore is to reduce the inside diameter of the vertical bore to hinder the occurrence of the unbalance phenomenon for assuring the prevention of the generation of turbulence zone of the molten steel between the molten steel stream line and the nozzle inside wall. In concrete terms, it is preferred to reduce the inside diameter of the vertical bore or to reduce the diameter in the direction of mold thickness to form an elliptical cross section while reducing its cross sectional area toward the bottom opening.

In addition, the inner hole between the exit port portion to the bottom slit opening is preferably in a form of high flatness further reducing the diameter in the direction of thickness of the mold, and preferably reducing the cross sectional area along the downflow of the molten steel corresponding to the discharge rate of the molten steel through the exit ports and the bottom slit.

The shape of S2 nozzle was derived from the above-described observation. The portion between the exit ports to the opening of bottom slit was formed in a quasi-ellipsoidal cross section with high flatness and with a reduction of the diameter in the direction of thickness of mold corresponding to the flow rate coming out from the bottom slit, and the major axis dimension of the ellipse was reduced along the parabola to form a downward convex opening of the bottom slit.

The shape of S3 nozzle was further improved from the shape of S2 nozzle. The top cross section of the vertical bore in the nozzle was circular to connect with a sliding nozzle. The portion from the nozzle top toward the exit ports gradually reduced the minor axis dimension to form an ellipsoidal cross section and reduced its cross sectional area. The ellipse was formed by reducing the diameter of the vertical bore in the direction of thickness of the mold. The first object of the orientation of the ellipse was to correct a cross section of the molten steel flow being unbalanced to a flat pattern and to obtain an effect of diminishing the turbulence region of the molten steel on the other side. The second object was to maintain the opening width in the length direction of the bottom slit at a wide dimension by reducing the inside diameter in the slit direction not by reducing the inside diameter in the length direction of the slit at the upstream of vertical bore.

Figure 19A:
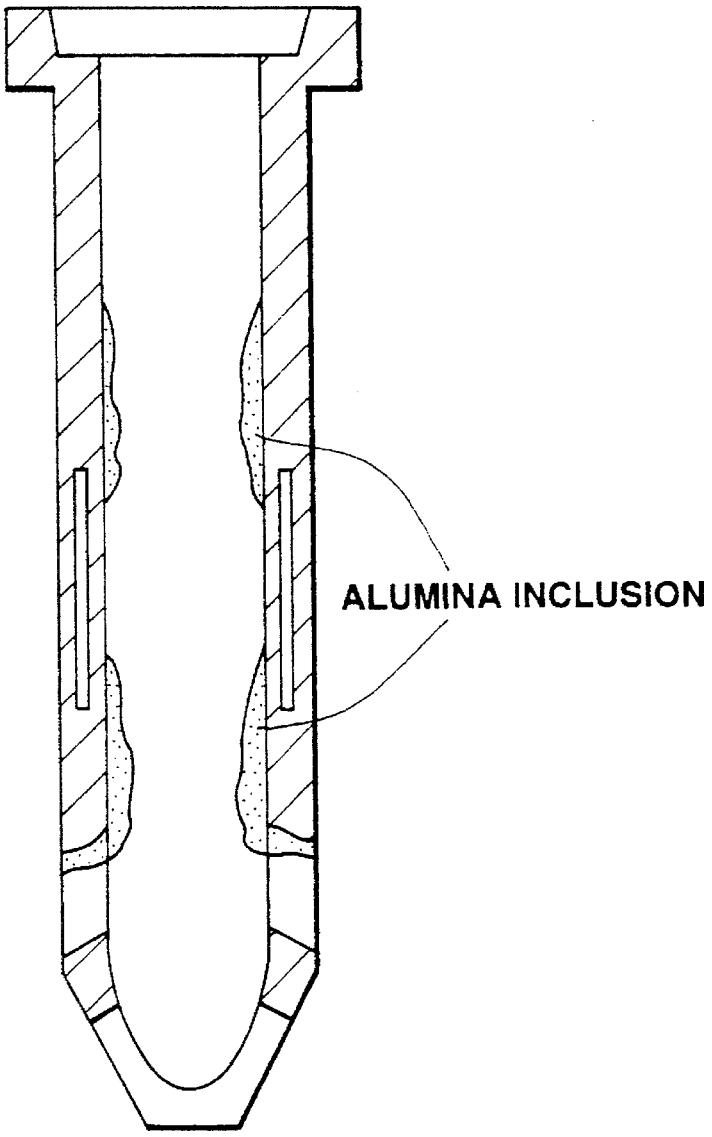
FIGS. 19)A) and 19(B) illustrate a state of adhered inclusion inside of an S3 immersion nozzle of the present invention.
Figure 19B:
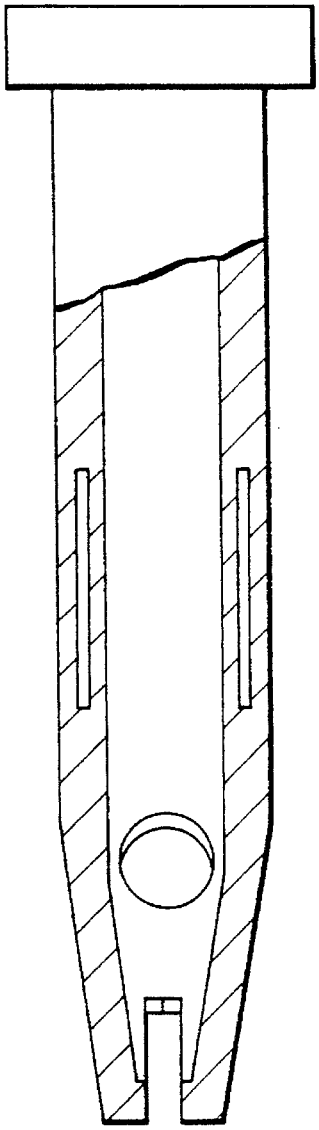
Figure 20A:
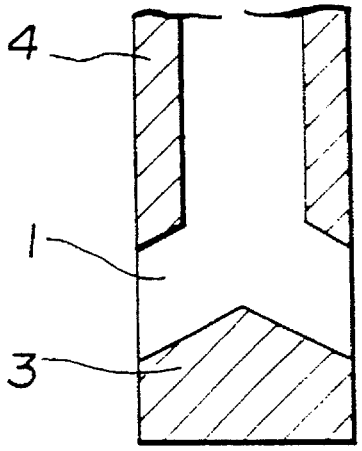
FIG.20(A) (PRIOR ART)
FIGS. 20(A) and 20(B) illustrate a prior art two-exit port nozzle with connected slit having an angle portion or a pool zone.
Figure 20B:
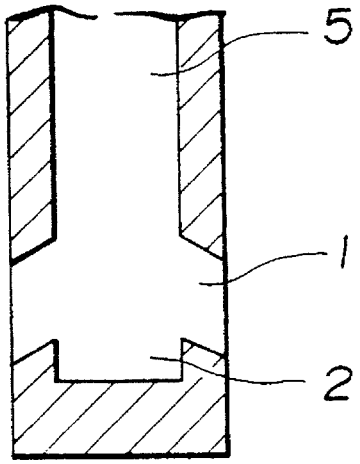
FIG.20(B) (PRIOR ART)

FIGS. 19(A) and 19(B) show the state of alumina inclusion adherence on the inside wall surface of the S3 nozzle observed after casting. In a portion from the top of vertical bore toward the exit ports, the amount of adhered alumina inclusion onto the inside wall surface significantly reduced on both left and right exit port sides, or on the inside wall surface corresponding to the short side of the mold in the vertical bore. No alumina inclusion was adhered on the inside wall surface between the exit port portion to the opening of bottom slit. Thus, the improvement effect was observed on the whole nozzle inside region. Although a slight amount of alumina inclusion was found to adhere at above the exit ports in the vertical bore, the phenomenon should be solved by further reduction of the cross sectional area at that portion.

As for the state of adhesion of alumina inclusion in the S2 nozzle, though its illustrative drawing is not given here, the amount of the adhered alumina inclusion at the portion ranging from the top of the vertical bore toward the exit ports was nearly equal to that on the S1 nozzle. In this respect, the S2 nozzle was not improved from the S1 nozzle. However, no alumina adhesion was found in a portion from the exit ports to the opening of the bottom slit showing a improvement on this portion.

From the observation of above-described casting tests and water model tests, it was found that the adhesion of alumina inclusion onto the inside wall surface of the vertical bore or onto the area near the inside opening of the bottom slit in the immersion nozzle of the invention is prevented by selecting the horizontal cross sectional shape of the vertical bore to an ellipse or flat section which cross sectional area reduces downward while continuously reducing the inside cross sectional area toward the inside opening.

As detailed above, the immersion nozzle of the present invention which prevents adhesion of alumina inclusion was confirmed to maintain the surface level fluctuation of the molten steel in the mold within an optimum range throughout the operation from the first heat to the final heat even in a multi-heat continuous casting operation.

What is claimed is:

1. An immersion nozzle for continuous casting comprising:

(a) an immersion nozzle body leading molten metal from a tundish into a mold for continuous casting;

(b) said immersion nozzle body having an opening hole at a top end of said immersion nozzle body, said opening hole receiving the molten metal from the tundish;

(c) said immersion nozzle body having a vertical bore which has a center axis;

(d) said immersion nozzle body having at least one pair of exit ports, said at least one pair of exit ports introducing the molten metal from said vertical bore into the mold, said exit ports being located symmetrically with regard to a cross sectional plane passing through a center axis of said vertical bore;

(e) said immersion nozzle body having a slit opening for introducing the molten metal downwardly into said mold, the slit opening being located at a level lower than said exit ports and with the slit opening not being connected with the exit ports, a direction of the slit opening being substantially the same as a direction of a line connecting respective centers of the two exit ports of the at least one .pair of exit ports; and (f) a bottom of said vertical bore having a downwardly convex surface below said exit ports.

2. The immersion nozzle of claim 1, wherein the bottom of said vertical bore forms a downwardly convex line symmetrical with regard to a cross sectional plane which passes through a center axis of said body of said immersion nozzle and which is in parallel to the width direction of the mold, and forms a downwardly convex line symmetrical with regard to a cross sectional plane which passes through a center axis of said body of said immersion nozzle and which is perpendicular to the width direction of the mold.

3. The immersion nozzle of claim 1, wherein the bottom of said bore forms a downwardly convex curve line symmetrical with regard to a cross sectional plane which passes through a center axis of said body of said immersion nozzle and which is in parallel to the width direction of the mold, and forms a downwardly convex line symmetrical with regard to a cross sectional plane which passes through a center axis of said body of said immersion nozzle and which is perpendicular to the width direction of the mold.

4. The immersion nozzle of claim 1, wherein said exit ports have an angle of $\alpha$ directed downwardly with regard to a horizontal plane and the slit opening has an angle of $\beta$ spreading downwardly in the width direction of the mold, the angle of $\alpha$ and the angle of $\beta$ satisfying an equation of:

$$2\alpha+\beta\leqq 210.$$

5. The immersion nozzle of claim 1, wherein an uppermost top end of the slit opening is downwardly apart at least 20 mm from a lowest end of said exit ports.

6. An immersion nozzle for continuous casting comprising:

(a) an immersion nozzle body leading molten metal from a tundish into a mold for continuous casting;

(b) said immersion nozzle body having an opening hole for receiving the molten metal from the tundish at a top end of said body of said immersion nozzle;

(c) said immersion nozzle body having a vertical bore which has a center axis, a horizontal cross sectional area of said bore being reduced in a direction downwardly from the top end of said body of said immersion nozzle;

(d) said immersion nozzle body having at least one pair of exit ports for introducing the molten metal from said vertical bore into the mold , said exit ports being located symmetrically with regard to a cross sectional plane passing through a center axis of said vertical bore;

(e) said immersion nozzle body having a slit opening for introducing the molten metal downwardly through said exit ports, the slit opening being located at a level lower than said exit ports and with the slit opening not being connected with the exit ports, a direction of the slit opening being substantially the same as a direction of a line connecting respective centers of the two exit ports of the at least one pair of exit ports; and (f) a bottom of said vertical bore being formed with a downwardly convex surface below said exit ports.

7. The immersion nozzle of claim 6, wherein the bottom of said vertical bore forms a downward convex line symmetrical with regard to a cross sectional plane which passes through a center axis of said body of said immersion nozzle and which is in parallel to the width direction of the mold, and forms a downward convex line symmetrical with regard to a cross sectional plane which passes through a center axis of said immersion nozzle body and which is perpendicular to the width direction of the mold.

8. The immersion nozzle of claim 6, wherein a bottom shape of said bore forms a downward convex curve line symmetrical with regard to a cross sectional plane which passes through a center axis of said body of said immersion nozzle and which is in parallel to the width direction of the mold, and forms a downward convex line symmetrical with regard to a cross sectional plane which passes through a center axis of said body of said immersion nozzle and which is perpendicular to the width direction of the mold.

9. The immersion nozzle of claim 6, wherein the opening hole at the top end of said body of said immersion nozzle has a horizontal cross sectional area of $A_0$ and said vertical bore has a horizontal cross sectional area of $A_1$ at a center point of the exit port, a ratio of $A_1$ to $A_0$ satisfying an equation of:

$$A_1/A_0\leqq 0.7,$$

said vertical bore having a horizontal cross sectional area of A from a center point of the exit port to a top end of the slit opening, satisfying an equation of:

$$\{(dA/dX)(X_1/A_1)\}\leqq -0.3;\text{ and}$$

said vertical bore having a horizontal cross sectional area of $A_2$ in the bottom satisfying an equation of:

$$A_2/A_1\leqq 0.7,$$

where $A_1$ is a horizental cross sectional area($cm^2$) at a level of the center point of the exit port; $X_1$ is a distance(cm) from the level of the center point of the exit port to the top end of the slit opening; A is a horizontal cross sectional area($cm^2$) at an arbitrary level; and X is a vertical distance from the center point of the exit port.

10. The immersion nozzle of claim 1, wherein there is only one pair of exit ports.

11. The immersion nozzle of claim 1, wherein said slit opening has a gap opening of 10 to 40 mm.

12. The immersion nozzle of claim 1, wherein an uppermost top end of the slit opening is downwardly apart 20 to 60 mm from a lowest end of said exit ports.

13. The immersion nozzle of claim 6, wherein there is only one pair of exit ports.

14. The immersion nozzle of claim 6, wherein said slit opening has a gap opening of 10 to 40 mm.

15. The immersion nozzle of claim 6, wherein an uppermost top end of the slit opening is downwardly apart 20 to 60 mm from a lowest end of said exit ports.

* * * * *